US008196965B2

(12) United States Patent
Tokita

(10) Patent No.: US 8,196,965 B2
(45) Date of Patent: Jun. 12, 2012

(54) FOLDED LABEL, ARTICLE WITH FOLDED LABEL AND METHOD OF MANUFACTURING SAME

(75) Inventor: Yoshiaki Tokita, Tokyo (JP)

(73) Assignee: Kyodo Shiko Co., Ltd., Tokyo (JP)

( * ) Notice: Subject to any disclaimer, the term of this patent is extended or adjusted under 35 U.S.C. 154(b) by 618 days.

(21) Appl. No.: 12/308,172

(22) PCT Filed: Jun. 15, 2007

(86) PCT No.: PCT/JP2007/062182
§ 371 (c)(1),
(2), (4) Date: Dec. 9, 2008

(87) PCT Pub. No.: WO2008/004429
PCT Pub. Date: Jan. 10, 2008

(65) Prior Publication Data

US 2009/0206594 A1 Aug. 20, 2009

(30) Foreign Application Priority Data

Jul. 6, 2006 (JP) ..... 2006-186237
May 17, 2007 (JP) ..... 2007-131962

(51) Int. Cl.
*B42D 15/00* (2006.01)

(52) U.S. Cl. ..... 283/81; 156/DIG. 11

(58) Field of Classification Search ..... 283/81; 40/672; 156/DIG. 11
See application file for complete search history.

(56) References Cited

U.S. PATENT DOCUMENTS 4,534,582 A * 8/1985 Howard ..... 283/81
4,592,572 A * 6/1986 Instance ..... 281/2
4,744,161 A * 5/1988 Instance ..... 40/638
5,263,743 A 11/1993 Jones
5,700,537 A * 12/1997 Instance ..... 428/41.9
5,830,550 A * 11/1998 Treleaven et al. ..... 428/40.1

(Continued)

FOREIGN PATENT DOCUMENTS

EP 0 087 987 9/1983

(Continued)

OTHER PUBLICATIONS

Mar. 3, 2011 Extended Search Report issued in European Application No. 07745436.1.

*Primary Examiner* — Paul N Dickson
*Assistant Examiner* — Kristina Junge
(74) *Attorney, Agent, or Firm* — Oliff & Berridge, PLC

(57) ABSTRACT

A folded label is produced without necessity of adhering any portions of a sheet to each other. The label uses only one sheet having display contents described on predetermined portions on both surface sides thereof. The label is formed by folding the sheet. Sheet sections are superposed over each other, being partitioned by a folding line. First and second sheet sections are adjacent and continuous to each other through the folding line and appear on upper and lower surface sides of the label, respectively. Only the first sheet section appears on the upper surface side of the label. The second sheet section and only one part of the first sheet section constituting a protruding portion protruding from the second sheet section on a side opposite to a side of the first folding line appear on the lower surface side of the label. Perforated lines are formed in the first sheet section.

14 Claims, 35 Drawing Sheets

U.S. PATENT DOCUMENTS

| | | | | |
|---|---|---|---|---|
| 5,860,238 | A * | 1/1999 | Anderson | 40/630 |
| 2004/0239102 | A1 | 12/2004 | Rollain et al. | |
| 2006/0208478 | A1 * | 9/2006 | Schneitter | 283/81 |

FOREIGN PATENT DOCUMENTS

| | | |
|---|---|---|
| EP | 0 370 633 | 5/1990 |
| JP | A-59-221235 | 12/1984 |
| JP | U-06-055161 | 7/1994 |
| JP | A-08-101640 | 4/1996 |
| JP | A-09-305112 | 11/1997 |
| JP | A-11-149247 | 6/1999 |
| JP | A-11-180067 | 7/1999 |

* cited by examiner (a)

(b)

FOLDED LABEL, ARTICLE WITH FOLDED LABEL AND METHOD OF MANUFACTURING SAME

TECHNICAL FIELD

The present invention relates to a folded label, an article with the folded label and a method of manufacturing the same.

BACKGROUND ART

As disclosed in the following Patent Documents 1 to 3, there have been heretofore proposed folded labels each of which uses only one sheet having display contents described on predetermined portions on both sides of the sheet for display of a large amount of information and each of which is formed by folding the sheet.

In each of the folded labels disclosed in Patent Documents 1 to 3, among a plurality of sheet sections superposed over each other into which the sheet is partitioned by one or more folding lines, only a first sheet section appears on one surface side of the folded label while only a second sheet section appears on the other surface side of the folded label. Predetermined portions of the sheet are adhered to each other by an adhesive to prevent the folded label from being unfolded to thereby keep the folded label in a folded state.

When each of these folded labels is attached on an article such as a container, the second sheet section on the other surface side of the folded label is adhered to the article by an adhesive.

Incidentally, each of these folded labels is formed so that a consumer or the like can unfold the label when the consumer or the like wants to watch the whole display contents of the label.

Patent Document 1: JP-U-06-55161
Patent Document 2: JP-A-08-101640
Patent Document 3: JP-A-11-149247

DISCLOSURE OF THE PRESENT INVENTION

Problem to be Solved by the Invention

Since the predetermined portions of the sheet are adhered to each other by the adhesive in the folded label according to the prior art, the number of steps for label production is increased and cost is increased because it is necessary to use a production apparatus which can perform application of an adhesive at the time of label production.

The present invention has been made in view of the circumstance as mentioned above, and it is an object of the present invention to provide a folded label which can be produced in such a manner that no portions of a sheet need to be adhered to each other to thereby achieve cost reduction, an article with the folded label and a method of manufacturing the article with the folded label.

Means for Solving the Problem

In order to solve the foregoing problem, a folded label according to a first aspect of the present invention is a folded label which uses only one sheet having display contents described on predetermined portions on both surface sides of the sheet and which is formed by folding the sheet without any portions of the sheet adhered to each other, wherein: (i) among a plurality of sheet sections superposed over each other into which the sheet is partitioned by one or more folding lines, first and second sheet sections adjacent and continuous to each other through a first folding line of the one or more folding lines appear on one surface side and the other surface side of the folded label, respectively, when the folded label is folded; (ii) only the first sheet section appears on the one surface side of the folded label; (iii) the second sheet section and only one part of the first sheet section constituting a protruding portion protruding from the second sheet section on a side opposite to a side of the first folding line appear on the other surface side of the folded label; and (iv) one or a plurality of perforated lines for separating the first sheet section into parts on sides of the protruding portion and the first folding line are formed on the first sheet section.

The plurality of perforated lines may form a zonal tear-off portion. This point can also apply to respective aspects which will be described later.

In addition, the perforated line means a pattern of perforations provided intermittently so that cutting can be made along the perforations. The perforated line is not necessarily limited to a pattern of a simple dotted line. This point can also apply to respective aspects which will be described later.

Since the folded label according to the first aspect is formed without any portions of the sheet adhered to each other, all the sheet sections are not particularly kept in a folded state before the folded label is adhered to an article such as a container. Since the folded label according to the first aspect satisfies the requisites (i) to (iii), all the sheet sections are however kept in a folded state after, for example, the protruding portion and the second sheet section of the folded label on the other surface side of the folded label are adhered to the article. When a consumer or the like wants to watch the whole display contents of the folded label, the consumer or the like can unfold the label easily by cutting the label along the perforated line or lines, because the folded label satisfies the requisite (iv).

As described above, the folded label according to the first aspect uses only one sheet and is formed by folding the sheet. However, none of portions of the sheet adhered to each other. Accordingly, the production process becomes simple and cost can be reduced because it is not necessary to use a production apparatus which can perform application of an adhesive.

A folded label according to a second aspect of the present invention is a folded label which uses only one sheet having display contents described on predetermined portions on both surface sides of the sheet and which is formed by folding the sheet without any portions of the sheet adhered to each other, wherein: (i) among three or more sheet sections superposed over each other each into which the sheet is partitioned by two or more folding lines, first and second sheet sections adjacent and continuous to each other through a first folding line of the two or more folding lines appear on one surface side and the other surface side of the folded label, respectively, when the folded label is folded; (ii) a third sheet section of the three or more sheet sections is adjacent and continuous to the first sheet section through a second folding line of the two or more folding lines; (iii) the first and second folding lines are located on opposite sides of the first sheet section; (iv) only the first sheet section appears on the one surface side of the folded label; (v) the second sheet section and only one part of the third sheet section constituting a protruding portion protruding from the second sheet section on a side opposite to the side of the first folding line appear on the other surface side of the folded label; and (vi) one or a plurality of perforated lines for separating the first sheet section into parts on sides of the first folding line and the second folding line are formed on the first sheet section.

Since the folded label according to the second aspect is formed without any portions of the sheet adhered to each other, all the sheet sections are not particularly kept in a folded state before the folded label is adhered to an article such as a container. Since the folded label according to the second aspect satisfies the requisites (i) to (v), all the sheet sections are however kept in a folded state after, for example, the protruding portion and the second sheet section of the folded label on the other surface side of the folded label are adhered to the article. When a consumer or the like wants to watch the whole display contents of the folded label, the consumer or the like can unfold the label easily by cutting the label along the perforated line or lines, because the folded label satisfies the requisite (vi).

As described above, the folded label according to the second aspect uses only one sheet and is formed by folding the sheet. However, none of portions of the sheet adhered to each other. Accordingly, the production process becomes simple and cost can be reduced because it is not necessary to use a production apparatus which can perform application of an adhesive.

A folded label according to a third aspect of the present invention is a folded label which uses only one sheet having display contents described on predetermined portions on opposite surface sides of the sheet and which is formed by folding the sheet without any portions of the sheet adhered to each other, wherein: (i) among a plurality of sheet sections superposed over each over each into which the sheet is partitioned by one or more folding lines, first and second sheet sections adjacent and continuous to each other through a first folding line of the one or more folding lines appear on one surface side and the other surface side of the folded label, respectively, when the folded label is folded; (ii) only the first sheet section appears on the one surface side of the folded label; (iii) the second sheet section and only one part of the first sheet section constituting a protruding portion protruding from the second sheet section on a side opposite to the side of the first folding line appear on the other surface side of the folded label; and (iv) a release agent is formed on the protruding portion on the other surface side of the folded label.

Since the folded label according to the third aspect is formed without any portions of the sheet adhered to each other, all the sheet sections are not particularly kept in a folded state before the folded label is adhered to an article such as a container. Since the folded label according to the third aspect satisfies the requisites (i) to (iii), all the sheet sections are however kept in a folded state after, for example, the protruding portion and the second sheet section of the folded label on the other surface side of the folded label are adhered to the article. Since the folded label satisfies the requisite (iv), the protruding portion of the folded label is adhered to the article through the release agent by an adhesive, so that the adhesive strength of the adhesive in the protruding portion becomes comparatively weak. Accordingly, the protruding portion of the folded label can be released from the article comparatively easily, so that when a consumer or the like wants to watch the whole display contents of the label, the consumer or the like can unfold the folded label easily by releasing the protruding portion from the article.

As described above, the folded label according to the third aspect uses only one sheet and is formed by folding the sheet. However, none of portions of the sheet adhered to each other. Accordingly, the production process becomes simple and cost can be reduced because it is not necessary to use a production apparatus which can perform application of an adhesive.

Incidentally, the release agent is an agent which weakens the adhesive strength of an adhesive at the time of adhering with the adhesive so as to make release easily. For example, so-called release varnish (e.g. "release OP varnish" made by DIC Corporation in Japan) etc. may be an example of the release agent. The release agent can be formed in advance, for example, by printing etc. These points can also apply to the following respective aspects.

A folded label according to a fourth aspect of the present invention is a folded label which uses only one sheet having display contents described on predetermined portions on both surface sides of the sheet and which is formed by folding the sheet without any portions of the sheet adhered to each other, wherein: (i) among three or more sheet sections superposed over each other each into which the sheet is partitioned by two or more folding lines, first and second sheet sections adjacent and continuous to each other through a first folding line of the two or more folding lines appear on one surface side and the other surface side of the folded label, respectively, when the folded label is folded; (ii) a third sheet section of the three or more sheet sections is adjacent and continuous to the first sheet section through a second folding line of the two or more folding lines; (iii) the first and second folding lines are located on opposite sides of the first sheet section; (iv) only the first sheet section appears on the one surface side of the folded label; (v) the second sheet section and only one part of the third sheet section constituting a protruding portion protruding from the second sheet section on a side opposite to the side of the first folding line appear on the other surface side of the folded label; and (vi) a release agent is formed on the protruding portion on the other surface side of the folded label.

Since the folded label according to the fourth aspect is formed without any portions of the sheet adhered to each other, all the sheet sections are not particularly kept in a folded state before the folded label is adhered to an article such as a container. Since the folded label according to the fourth aspect satisfies the requisites (i) to (v), all the sheet sections are however kept in a folded state after, for example, the protruding portion and the second sheet section of the folded label on the other surface side of the folded label are adhered to the article. Since the folded label satisfies the requisite (vi), the protruding portion of the folded label is adhered to the article through the release agent by an adhesive, so that the adhesive strength of the adhesive in the protruding portion becomes comparatively weak. Accordingly, the protruding portion of the folded label can be released from the article comparatively easily, so that when a consumer or the like wants to watch the whole display contents of the label, the consumer or the like can unfold the folded label easily by releasing the protruding portion from the article.

As described above, the folded label according to the fourth aspect uses only one sheet and is formed by folding the sheet. However, none of portions of the sheet adhered to each other. Accordingly, the production process becomes simple and cost can be reduced because it is not necessary to use a production apparatus which can perform application of an adhesive.

An article with a folded label according to a fifth aspect of the present invention has an article on which a folded label according to any one of the first to fourth aspects is attached, wherein the protruding portion and the second sheet section of the folded label on the other surface side of the folded label are adhered to the article by an adhesive.

As examples of the article, there are containers such as a box, a package, a jar, and a bottle. This point can also apply to respective aspects which will be described later.

Since the folded label according to any one of the first to fourth aspects is attached in the article with a folded label according to the fifth aspect, cost as the whole of the article with a folded label can be reduced.

An article with a folded label manufacturing method according to a sixth aspect of the present invention is a method for manufacturing an article with a folded label according to the fifth aspect, having the steps of: (i) preparing the folded label and the article to which the folded label is to be attached; (ii) applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and (iii) pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

The sixth aspect provides an example of a method of manufacturing an article with a folded label according to the fifth aspect. According to the sixth aspect, the folded label can be handled like one unfolded sheet by setting the both surface sides or direction of the folded label relative to the adsorption drum as in the aforementioned condition (ii), so that the article with a folded label according to the fifth aspect can be produced by utilizing an existing labeling machine (apparatus for sticking a label constituted by one unfolded sheet) etc. having the adsorption drum and the coating roller. Incidentally, if the folded label with the protruding portion side facing forward in the rotation direction of the adsorption drum and with the first folding line side facing backward in the rotation direction of the adsorption drum conversely to the case of the aforementioned condition (ii) is adsorbed by the adsorption drum, turning outward, creases, etc. may be caused easily in the folded label, so that the folded label cannot be attached onto the article properly. On the other hand, when the folded label is adsorbed by the adsorption drum as in the aforementioned condition (ii), turning outward, creases, etc. are hardly caused in the folded label, so that the folded label can be attached onto the article properly.

An article with a folded label according to a seventh aspect of the present invention has an article to which a folded label according to any one of the first to fourth aspects is attached, wherein: (i) the folded label with the one surface side facing outward and with the first folding line set as a winding initiation end portion is wound on an outer circumferential surface side of the article so that the number of turns of the folded label becomes more than one; (ii) at least one part of the second sheet section of the folded label on the other surface side of the folded label is adhered to the article by an adhesive; and (iii) at least one part of the protruding portion of the folded label on the other surface side of the folded label is adhered to one part of the first sheet section located on the one surface side of the folded label and facing the part of the protruding portion by the adhesive.

Since the folded label according to any one of the first to fourth aspects is attached in the article with a folded label according to the seventh aspect, cost as the whole of the article with a folded label can be reduced.

A folded label according to an eighth aspect of the present invention is a folded label which uses only one sheet having display contents described on predetermined portions on both surface sides of the sheet and which is formed by folding the sheet without any portions of the sheet adhered to each other, wherein: (i) among a plurality of sheet sections superposed over each other each into which the sheet is partitioned by one or more folding lines, first and second sheet sections adjacent and continuous to each other through a first folding line of the one or more folding lines appear on one surface side and the other surface side of the folded label, respectively, when the folded label is folded; (ii) only the first sheet section appears on the one surface side of the folded label; (iii) the second sheet section and only one part of the first sheet section constituting a protruding portion protruding from the second sheet section on a side opposite to a side of the first folding line appear on the other surface side of the folded label; (iv) a plurality of perforated lines for separating the first sheet section into parts on a side of the first folding line and a side opposite to the side are formed on the first sheet section; (v) the plurality of perforated lines form a zonal tear-off portion which can be torn off in the first sheet section; (vi) the tear-off portion contains a part of the protruding portion; and (vii) a release agent is formed on the protruding portion on the other surface side of the folded label and around the tear-off portion.

Since the folded label according to the eighth aspect is formed without any portions of the sheet adhered to each other, all the sheet sections are not particularly kept in a folded state before the folded label is adhered to an article such as a container. Since the folded label according to the eighth aspect satisfies the requisites (i) to (vii) all the sheet sections are however kept in a folded state after the folded label is wound on an outer circumferential surface of the article so as to be adhered to a predetermined portion as in a ninth aspect which will be described later. When a consumer or the like wants to watch the whole display contents of the folded label, the consumer or the like can unfold the label easily by tearing off the zonal tear-off portion because the folded label satisfies the requisites (v) to (vii). The article is exposed to the outside in the place where the tear-off portion was located after the zonal tear-off portion was torn off because the folded label satisfies the requisites (v) to (vii). Accordingly, if the article such as a container is transparent or translucent, the residual amount of the article contents can be checked easily.

An article with a folded label according to the ninth aspect of the present invention has an article to which a folded label according to the eighth aspect is attached, wherein: (i) the folded label with the one surface side facing outward and with the first folding line set as a winding initiation end portion is wound on an outer circumferential surface of the article so that the number of turns of the folded label becomes more than one; (ii) at least one part of the second sheet section of the folded label on the other surface side of the folded label is adhered to the article by an adhesive; (iii) one part of the protruding portion of the folded label on the other surface side of the folded label is adhered to one part of the first sheet section located on the one surface side of the folded label and facing the part of the protruding portion by the adhesive; and (iv) the other part of the protruding portion of the folded label on the other surface side of the folded label is adhered to the article facing the other part of the protruding portion by the adhesive.

Since the folded label according to any one of the first to fourth aspects is attached in the article with a folded label according to the ninth aspect, cost as the whole of the article with a folded label can be reduced.

Effect of the Invention

According to the present invention, it is possible to provide a folded label which is produced without necessity of adhering any portions of a sheet to each other, so that cost reduction can be achieved, an article with the folded label and a method of manufacturing the article with a folded label.

DESCRIPTION OF REFERENCE NUMERALS

1, 41, 51, 61, 71, 81, 91, 111, 141, 151, 161, 171, 181 folded label
2, 42, 62, 142 sheet
3, 43, 44, 63, 64, 65, 143, 144 folding line
4, 5, 45, 46, 47, 66, 67, 68, 69, 145, 146, 147 sheet section
4*a*, 47*a*, 68*a*, 145*a* protruding portion
6*a*, 6*b*, 48*a*, 48*b*, 70*a*, 70, 148*a*, 148*b* perforated line

BEST MODE FOR CARRYING OUT THE INVENTION

A folded label, an article with a folded label using the folded label and a method of manufacturing the article with a folded label according to the present invention will be described below with reference to the drawings.

First Embodiment

Figure 1:
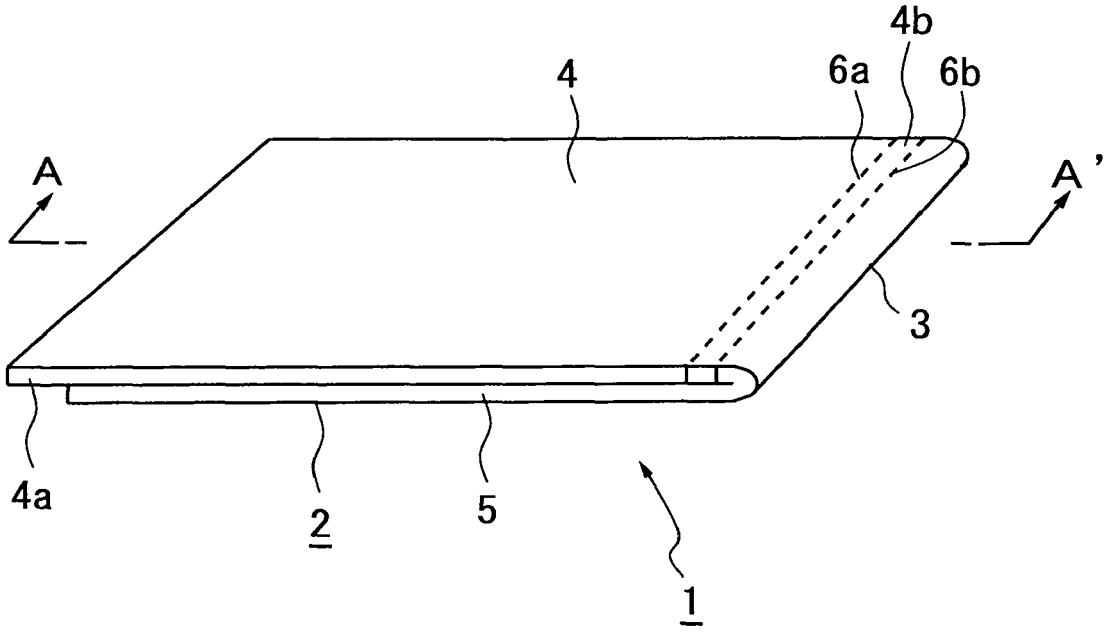
FIG. 1 is a schematic perspective view showing a folded label according to a first embodiment of the present invention.
Figure 2:
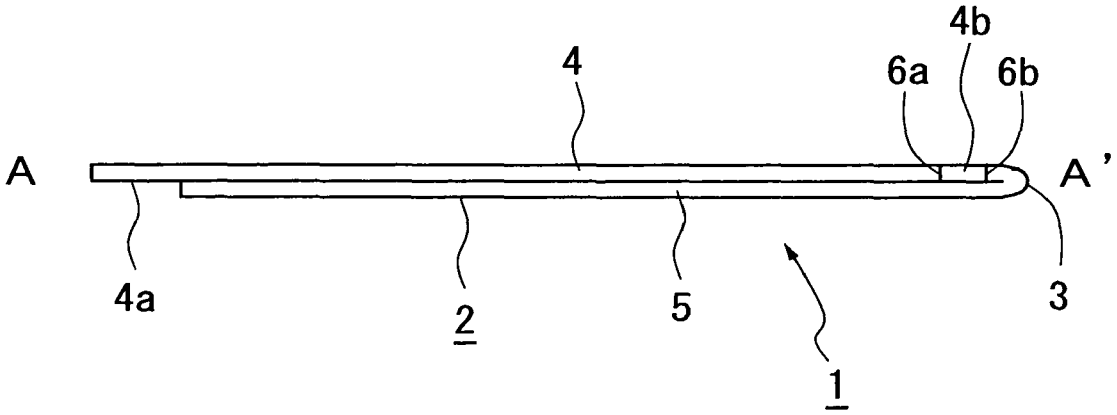
FIG. 2 is a schematic cross-sectional view taken along a line A-A' in FIG. 1.
Figure 3:
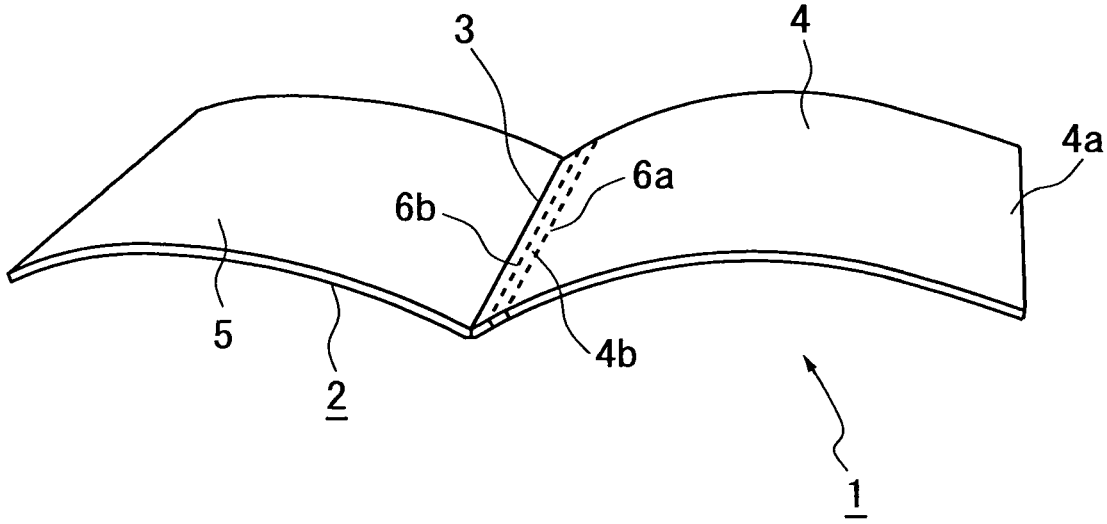
FIG. 3 is a schematic expansion view prior to folding, showing the folded label shown in FIG. 1.

FIG. 1 is a schematic perspective view showing a folded label 1 according to a first embodiment of the present invention. FIG. 2 is a schematic cross-sectional view taken along a line A-A' in FIG. 1. FIG. 3 is a schematic expansion view prior to folding, showing the folded label 1 according to the present embodiment.

This folded label 1 uses only one sheet 2 having display contents (not shown) described on predetermined portions on both surface sides thereof. The folded label 1 is formed by folding the sheet 2 without any portions of the sheet 2 adhered to each other.

Among a plurality of sheet sections 4 and 5 superposed over each other each into which the sheet is partitioned by one folding line 3, first and second sheet sections 4 and 5 adjacent and continuous to each other through the folding line 3 appear on upper and lower surface sides of the folded label 1, respectively, when the folded label 1 is folded. Only the first sheet section 4 appears on the upper surface side of the folded label 1. The second sheet section 5 and only one part of the first sheet section 4 constituting a protruding portion 4*a* protruding from the second sheet section 5 on a side opposite to a side of the folding line 3 appear on the lower surface side of the folded label 1.

Two perforated lines 6*a* and 6*b* for separating the first sheet section 4 into parts on the sides of the protruding portion 4*a* and the folding line 3 are formed on the first sheet section 4. In the present embodiment, the two perforated lines 6*a* and 6*b* form a zonal tear-off portion 4*b* in the first sheet section 4. It is a matter of course that only one perforated line 6*a* may be formed instead. Even in this case, the first sheet section 4 can be separated into parts by cutting along the perforated line 6*a*. Although the perforated lines 6*a* and 6*b* are formed near the folding line 3 in the present embodiment, positions where the perforated lines 6*a* and 6*b* are formed are not particularly limited as long as they are positions where the first sheet section 4 can be separated into parts on sides of the protruding portion 4*a* and the folding line 3.

A sheet of any one of various materials such as paper (e.g. paper high-quality paper), synthetic paper, a film and a material formed by sticking a film to paper can be used as the sheet 2. The sheet 2 may have a single surface side or both surface sides subjected to various kinds of treatment such as glazing, vanishing and water-resistant coating after printing display contents such as characters, figures and symbols.

Although the display contents are described by printing etc. in an area except for the lower surface of the protruding portion 4 and the lower surface of the sheet section 5 in the present embodiment, illustration of the display contents is omitted.

Figure 4:
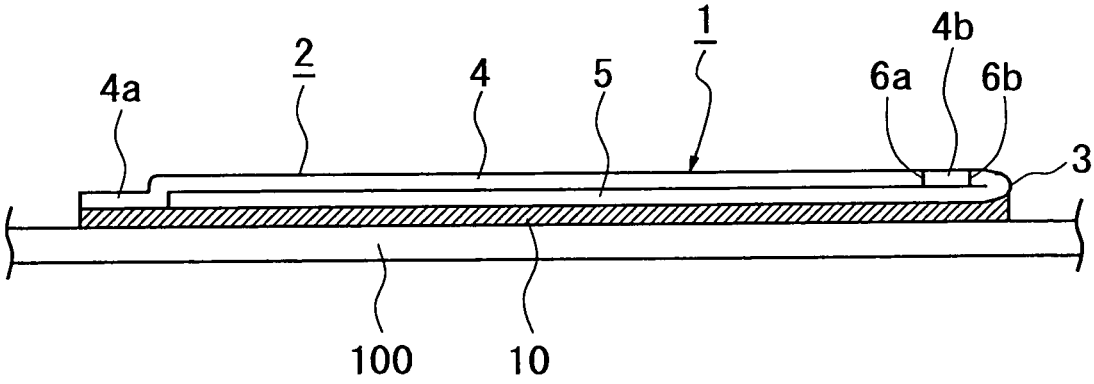
FIG. 4 is a schematic cross-sectional view showing a state that the folded label shown in FIG. 1 is attached to a bag.

FIG. 4 is a schematic cross-sectional view showing a state that the folded label 1 according to the present embodiment is attached to a bag 100 such as a rectangular-bottomed bag which is a container as an article. FIG. 4 corresponds to FIG. 2. Incidentally, FIG. 4 shows the bag 100 simplified greatly.

When this folded label 1 is attached to the article such as the bag 100 as shown in FIG. 4, the lower surface of the protruding portion 4*a* and the lower surface of the second sheet section 5 are adhered to the bag 100 by an adhesive 10. The adhesive 10 is not limited particularly. For example, starch glue or the like may be used as the adhesive 10.

Since the folded label 1 according to the present embodiment is formed without any portions of the sheet 2 adhered to each other, the respective sheet sections 4 and 5 are not particularly kept in a folded state before the folded label 1 is adhered to the article such as the bag 100 (see FIGS. 1 and 2). As it is understandable from FIG. 4, the respective sheet sections 4 and 5 are however kept in a folded state after the lower surface of the protruding portion 4*a* and the lower surface of the second sheet section 5 are adhered to the article such as the bag 100.

Figure 5:
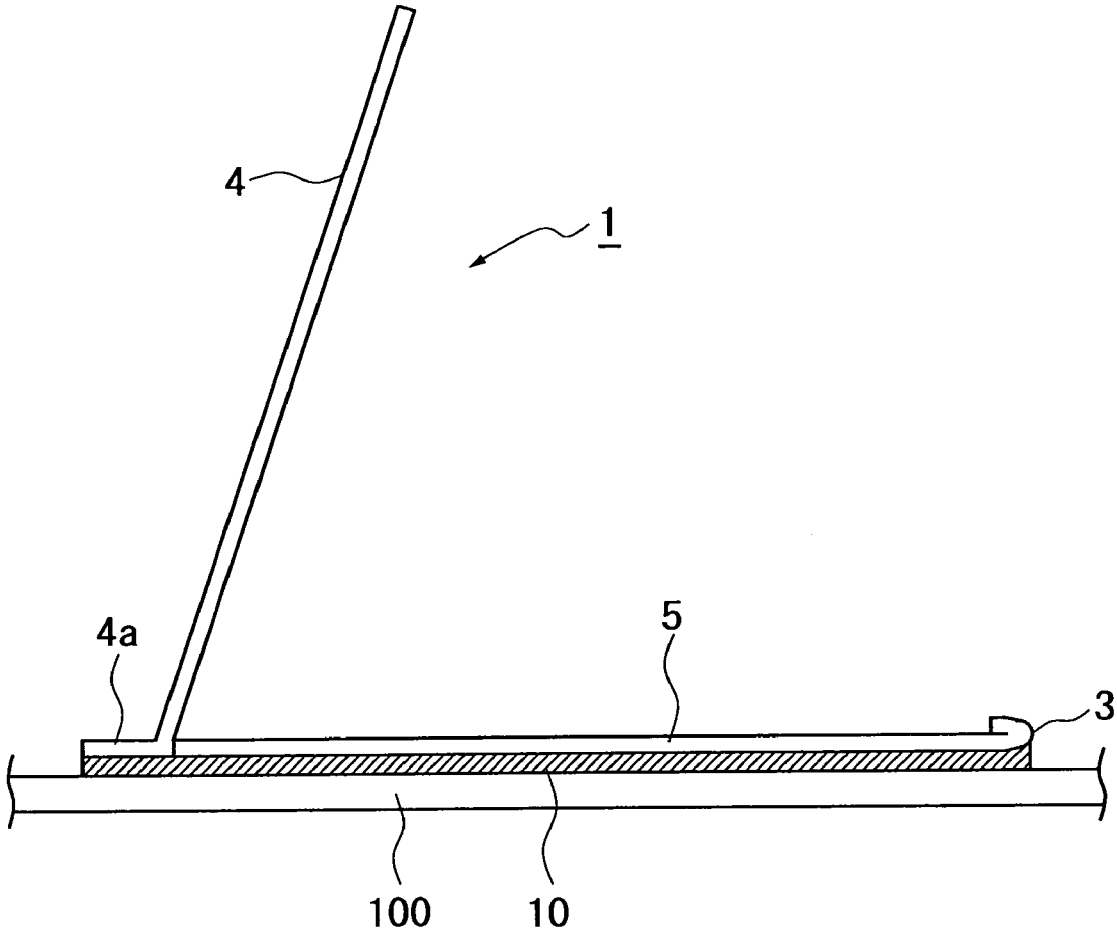
FIG. 5 is a schematic cross-sectional view showing a state that the folded label shown in FIG. 1 and attached on the bag is unfolded.

When a consumer or the like wants to watch the whole display contents of the folded label 1, the consumer or the like can unfold the folded label 1 easily, as shown in FIG. 5, by tearing off the tear-off portion 4*b* along the perforated lines 6*a* and 6*b*. FIG. 5 is a schematic cross-sectional view showing a state that the folded label 1 attached to the bag 100 is unfolded. FIG. 5 corresponds to FIG. 4.

As described above, the folded label 1 according to the present embodiment uses only one sheet 2 and is formed by folding the sheet 2. However, none of portions of the sheet 2 adhered to each other. Accordingly, the production process becomes simple and cost can be reduced because it is not necessary to use a production apparatus which can perform application of an adhesive.

Figure 6:
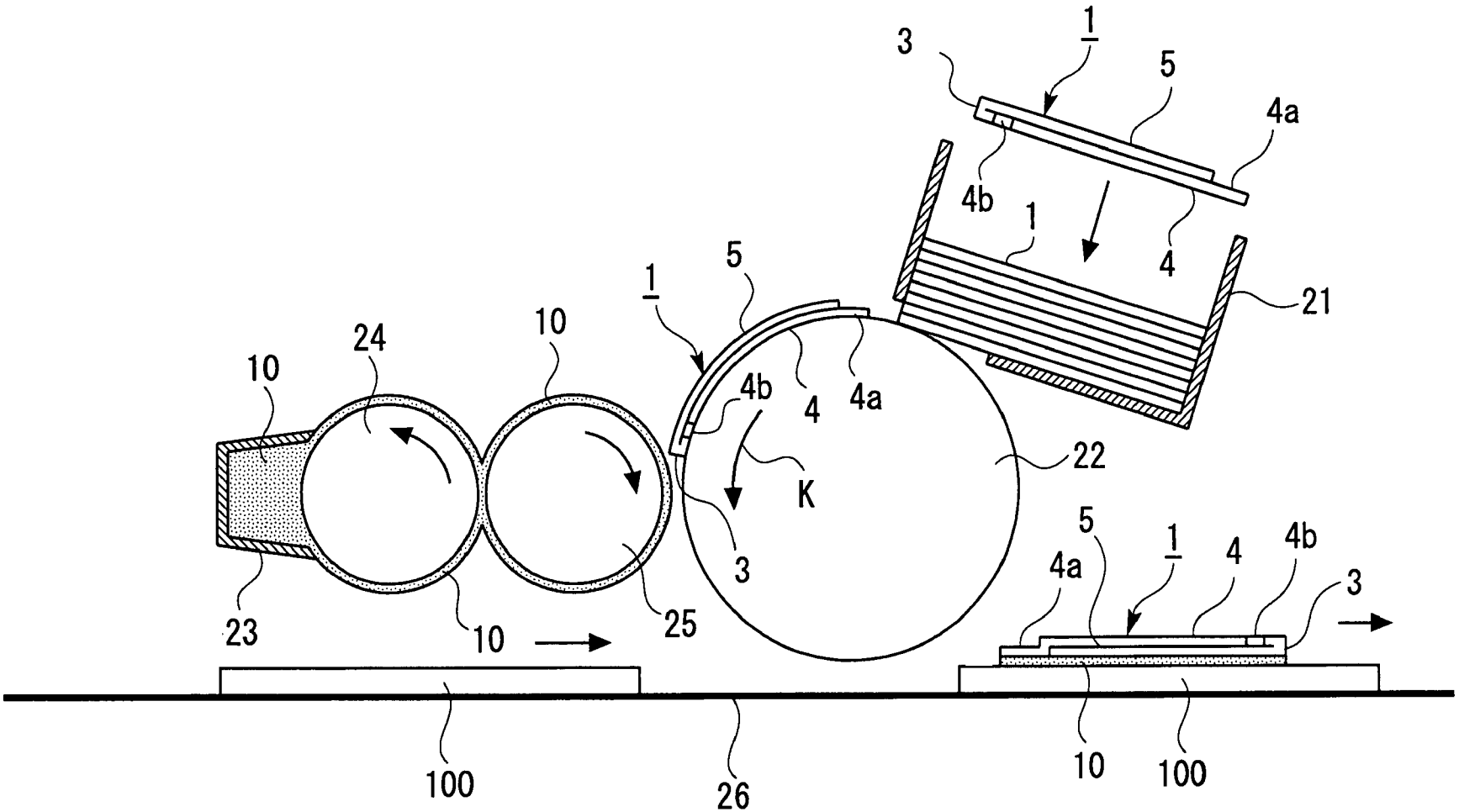
FIG. 6 is a schematic configuration view schematically showing a labeling machine.

An example of a method of manufacturing the article with a folded label (the bag 100 including the folded label 1 attached thereto in the present embodiment) shown in FIG. 4 will be described below with reference to FIG. 6. FIG. 6 is a schematic configuration view schematically showing a labeling machine used in the production.

This labeling machine includes a magazine 21 for receiving folded labels 1, an adsorption drum 22 for adsorbing a folded label 1 on its outer circumferential portion by an air vacuum (illustration of a suction port etc. thereof is omitted), a vessel 23 for holding an adhesive 10, a feeding roller 24 for feeding the adhesive 10 from the vessel 23, a coating roller 25 of rubber etc. for accepting the adhesive 10 fed by the feeding roller 24 and applying the adhesive 10 onto the folded label 1 adsorbed by the adsorption drum 22, and a conveyer 26 for conveying bags 100. A labeling machine for sticking a label constituted by one unfolded sheet on a bag 100 can be used directly as this labeling machine, and folded labels 1 in place of labels each constituted by one unfolded sheet are set in the magazine 21.

For production of folded label-including bags shown in FIG. 4, folded labels 1 are produced and prepared by printing of display contents on sheets 20, formation of perforated lines 6*a* and 6*b* in the sheets 20 and folding the sheets 20. On the other hand, bags 100 are prepared by a known method.

As shown in FIG. 6, the folded labels 1 are then set in the magazine 21 so that each folded label 1 with the second sheet section 5 facing outward and with the first sheet section 4 facing inward will be adsorbed by the adsorption drum 22 while the folded label 1 with the protruding portion 4*a* side facing backward in a rotation direction K of the adsorption drum 22 and with the folding line 3 side facing forward in the rotation direction K of the adsorption drum 22 will be adsorbed by the adsorption drum 22.

When the labeling machine shown in FIG. 6 is operated, one folded label 1 is adsorbed by the adsorption drum 22 and fed out from the magazine 21. On this occasion, the folded label 1 with the second sheet section 5 facing outward and with the first sheet section 4 facing inward is adsorbed by the adsorption drum 22 while the folded label 1 with the protruding portion 4*a* side facing backward in the rotation direction K of the adsorption drum 22 and with the folding line 3 side facing forward in the rotation direction K of the adsorption drum 22 is adsorbed by the adsorption drum 22.

Further, while the adsorption drum 22 is rotated in the rotation direction K, the adhesive 10 is applied onto outer surfaces (lower surfaces in FIG. 1 and FIG. 2) of the protruding portion 4*a* and the second sheet section 5 of the folded label 1 by the coating roller 25.

Then, while the adsorption drum 22 is rotated in the rotation direction K, the folded label 1 coated with the adhesive 10 by the coating roller 25 is pressed against a bag 100 conveyed by the conveyer 26 by the adsorption drum 22. In this manner, the outer surface of the folded label 1 (i.e. the outer surfaces of the protruding portion 4*a* and the second sheet section 5) is adhered to the bag 100. Thus, the bag with the folded label shown in FIG. 4 is completed.

The folded label 1 can be handled like one unfolded sheet by setting the both surface sides or direction of the folded label 1 relative to the adsorption drum 22 in a manner as described above in this production method, so that the bag with the folded label shown in FIG. 4 can be produced by utilizing an existing labeling machine etc. having the adsorption drum 22 and the coating roller 25.

Incidentally, if the folded label 1 with the protruding portion 4*a* side facing forward in the rotation direction K of the adsorption drum 22 and with the folding line 3 side facing backward in the rotation direction K of the adsorption drum 22 conversely to the case shown in FIG. 6 is adsorbed by the adsorption drum 22, turning outward, creases, etc. may be generated easily in the folded label 1, so that the folded label 1 cannot be attached onto the bag 100 properly. On the other hand, when the folded label 1 in the direction shown in FIG. 6 is adsorbed by the adsorption drum 22, turning outward, creases, etc. are hardly generated in the folded label 1, so that the folded label 1 can be attached onto the bag 100 properly.

Figure 7:
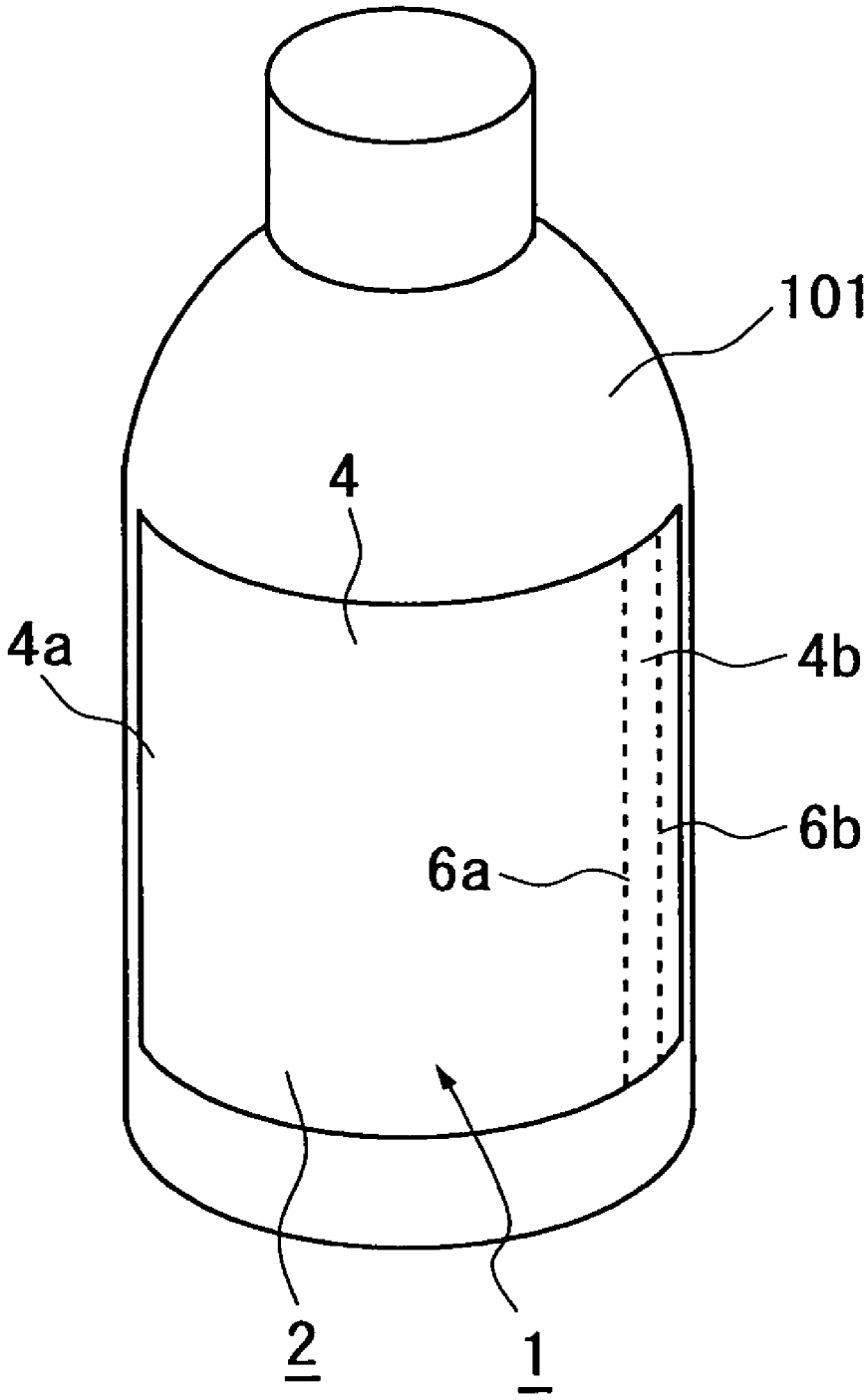
FIG. 7 shows a schematic perspective view showing a state that the folded label shown in FIG. 1 is attached to a bottle.

An article to which the folded label 1 can be attached is not limited to the bag 100. FIG. 7 shows an example where the folded label 1 is attached to a bottle 101. Adhering of the folded label 1 to the bottle 101 can be fundamentally performed by the labeling machine shown in FIG. 6. However, the conveyer 26 can be changed properly in accordance with the bottle 101.

Second Embodiment

Figure 8:
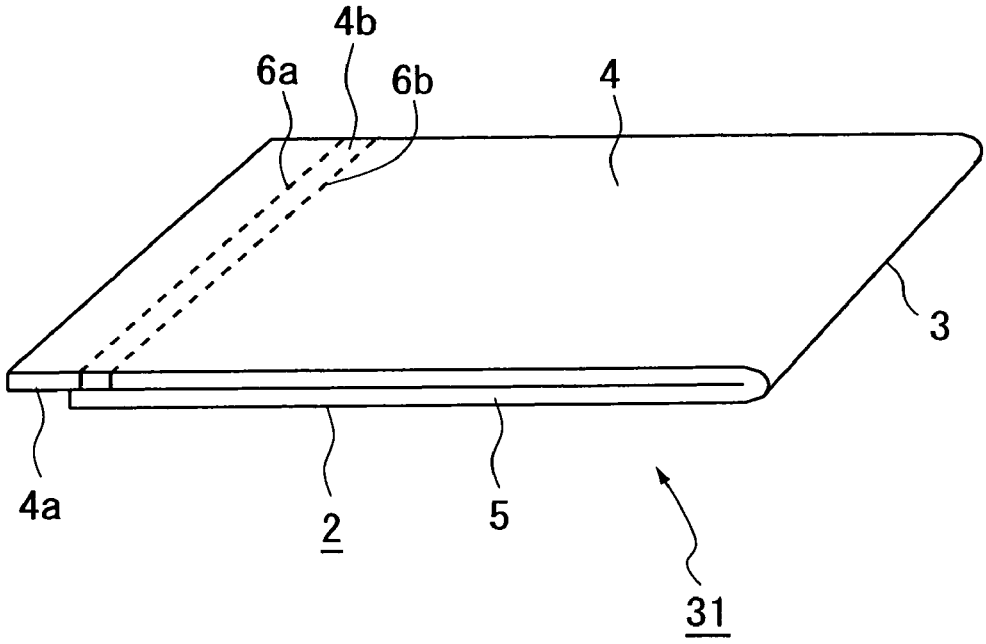
FIG. 8 is a schematic perspective view showing a folded label according to a second embodiment of the present invention.
Figure 9:
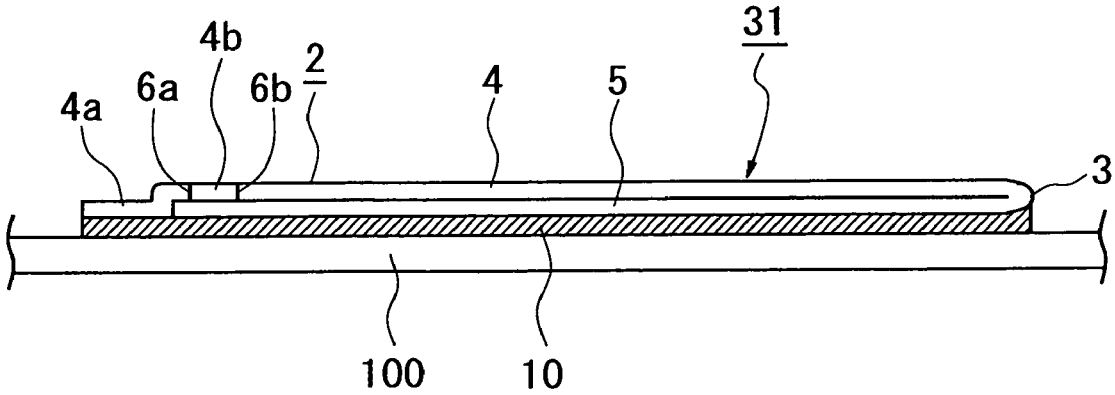
FIG. 9 is a schematic cross-sectional view showing a state that the folded label shown in FIG. 8 is attached to a bag.

FIG. 8 is a schematic perspective view showing a folded label 31 according to a second embodiment of the present invention. FIG. 8 corresponds to FIG. 1. FIG. 9 is a schematic cross-sectional view showing a state that the folded label 31 according to the present embodiment is attached to a bag 100. FIG. 9 corresponds to FIG. 4. In FIGS. 8 and 9, components identical or corresponding to those in FIGS. 1 and 4 are designated by the same reference numerals, and repetitive description thereon is omitted.

The folded label 31 according to the present embodiment differs from the folded label 1 shown in FIGS. 1 to 5 only in that perforated lines 6*a* and 6*b* are formed near a protruding portion 4*a*.

The present embodiment also provides similar advantages to those of the first embodiment.

Third Embodiment

Figure 10:
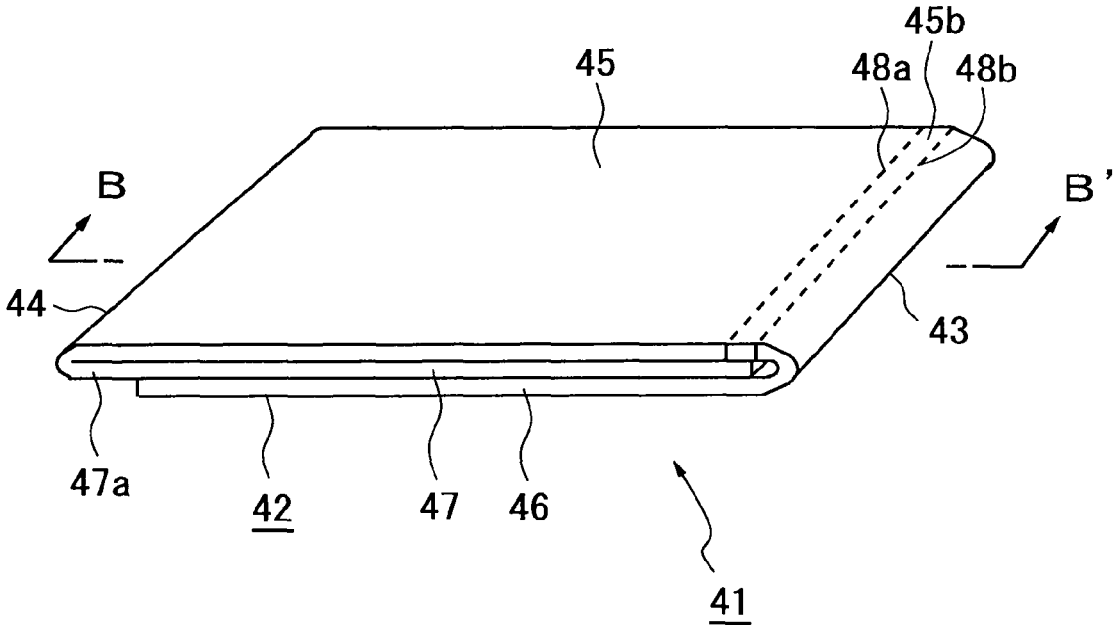
FIG. 10 is a schematic perspective view showing a folded label according to a third embodiment of the present invention.
Figure 11:
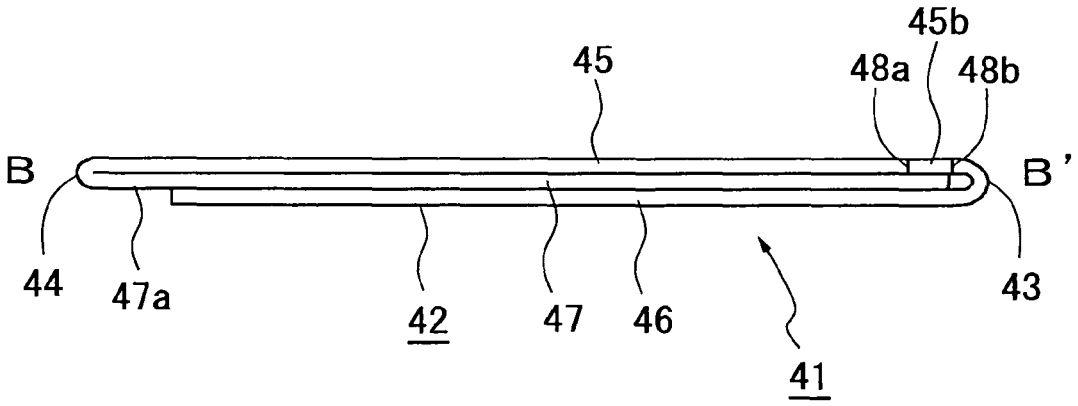
FIG. 11 is a schematic cross-sectional view taken along a line B-B' in FIG. 10.

FIG. 10 is a schematic perspective view showing a folded label 41 according to a third embodiment of the present invention. FIG. 11 is a schematic cross-sectional view taken along a line B-B' in FIG. 10.

This folded label 41 uses only one sheet 42 having display contents (not shown) described on predetermined portions on both surface sides thereof. The folded label 41 is formed by folding the sheet 42 without any portions of the sheet 42 adhered to each other.

Among three sheet sections 45, 46 and 47 superposed over each other each into which the sheet is partitioned by two folding lines 43 and 44, the first and second sheet sections 45 and 46 adjacent and continuous to each other through the first folding line 43 appear on upper and lower surface sides of the folded label 41, respectively, when the folded label 41 is folded. The third sheet section 47 is adjacent and continuous to the first sheet section 45 through the second folding line 44. The first and second folding lines 43 and 44 are located in opposite sides of the first sheet section 45.

Only the first sheet section 45 appears on the upper surface side of the folded label 41. The second sheet section 46 and only one part of the third sheet section 47 constituting a protruding portion 47*a* protruding from the second sheet section 46 on a side opposite to the side of the folding line 43 appear on the lower surface side of the folded label 41.

Two perforated lines 48*a* and 48*b* for separating the first sheet section 45 into parts on sides of the first folding line 43 and the second folding line 44 are formed on the first sheet section 45. In the present embodiment, the two perforated lines 48*a* and 48*b* form a zonal tear-off portion 45*b* in the first sheet section 45. It is a matter of course that only one perforated line 48*a* may be formed instead. Even in this case, the first sheet section 45 can be separated into parts by cutting along the perforated line 48*a*. Although the perforated lines 48*a* and 48*b* are formed near the folding line 43 in the present embodiment, positions where the perforated lines 48*a* and 48*b* are formed are not particularly limited as long as they are positions where the first sheet section 45 can be separated into parts on sides of the first folding line 43 and the second folding line 44.

A sheet of any one of various materials can be used as the sheet 42, similarly to the aforementioned sheet 2.

Although the display contents are described by printing etc. in an area except for the lower surface of the protruding portion 47*a* and the lower surface of the sheet section 46 in the present embodiment, illustration of the display contents is omitted.

Figure 12:
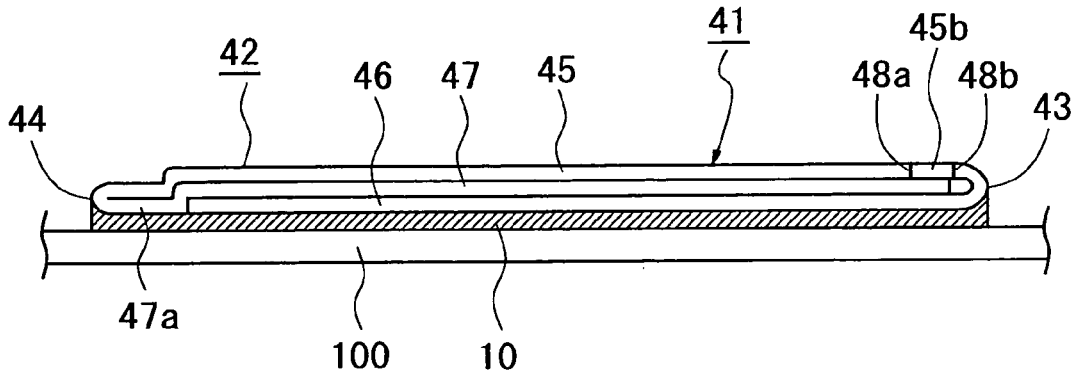
FIG. 12 is a schematic cross-sectional view showing a state that the folded label shown in FIG. 10 is attached to a bag.

FIG. 12 is a schematic cross-sectional view showing a state that the folded label 41 according to the present embodiment is attached to a bag 100 such as a rectangular-bottomed bag which is a container as an article. FIG. 12 corresponds to FIG. 11.

When this folded label 41 is attached to the article such as the bag 100 as shown in FIG. 12, the lower surface of the protruding portion 47*a* and the lower surface of the second sheet section 46 are adhered to the bag 100 by an adhesive 10.

Since the folded label 41 according to the present embodiment is formed without any portions of the sheet 42 adhered to each other, the respective sheet sections 45, 46 and 47 are not particularly kept in a folded state before the folded label 41 is adhered to the article such as the bag 100 (see FIG. 10 and FIG. 11). As it is understandable from FIG. 12, the respective sheet sections 45, 46 and 47 are however kept in a folded state after the lower surface of the protruding portion 47*a* and the lower surface of the second sheet section 46 are adhered to the article such as the bag 100.

Figure 13:
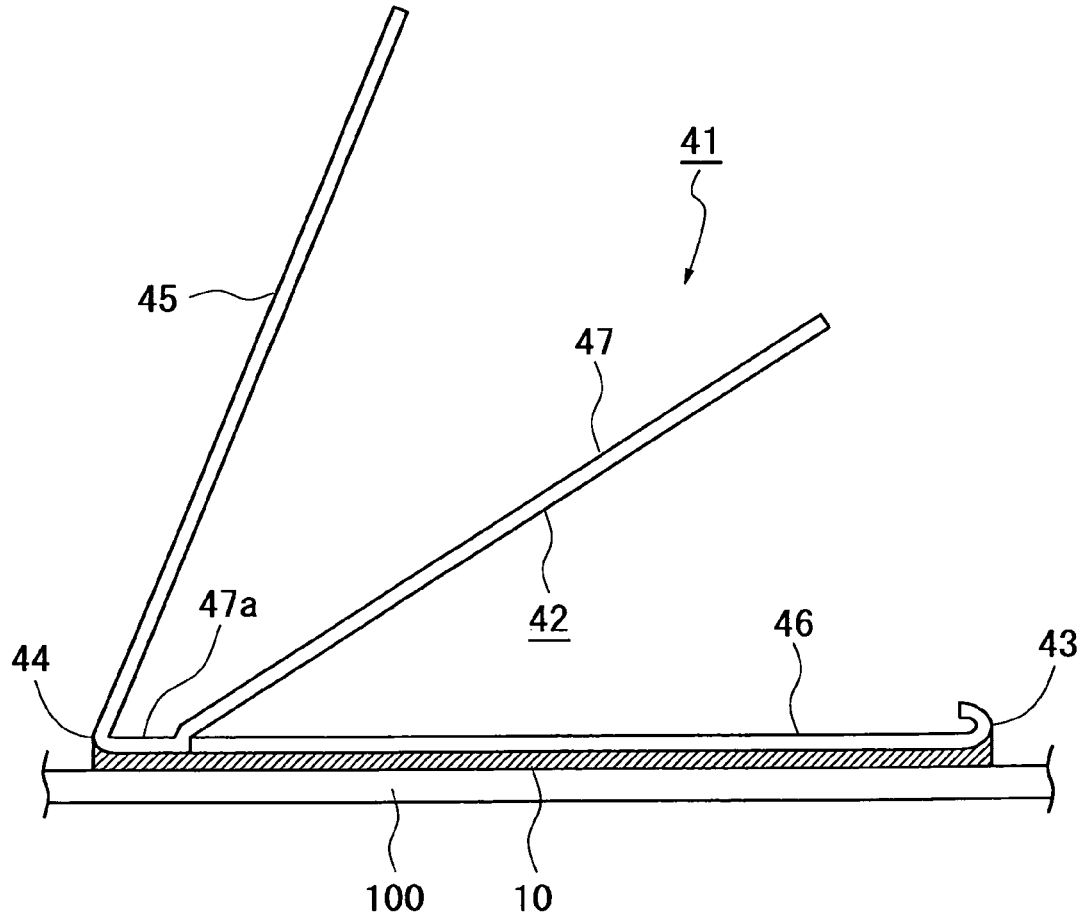
FIG. 13 is a schematic cross-sectional view showing a state that the folded label shown in FIG. 10 and attached to the bag is unfolded.

When a consumer or the like wants to watch the whole display contents of the folded label 41, the consumer or the like can unfold the folded label 41 easily, as shown in FIG. 13, by tearing off the tear-off portion 45*b* along the perforated lines 48*a* and 48*b*. FIG. 13 is a schematic cross-sectional view showing a state that the folded label 41 attached to the bag 100 is unfolded. FIG. 13 corresponds to FIG. 12.

As described above, the folded label 41 according to the present embodiment uses only one sheet 42 and is formed by folding the sheet 42. However, none of portions of the sheet 42 adhered to each other. Accordingly, the production process becomes simple and cost can be reduced because it is not necessary to use a production apparatus which can perform application of an adhesive.

The article with a folded label (the bag 100 including the folded label 41 attached thereon in the present embodiment) shown in FIG. 12 can be produced in a manner similar to the aforementioned article with a folded label shown in FIG. 4. When the labeling machine shown in FIG. 6 is used for sticking the folded labels 41 on the bags 100, the folded labels 41 are set in the magazine 21 so that each folded label 41 with the second sheet section 46 facing outward and with the first sheet section 45 facing inward will be adsorbed by the adsorption drum 22 while the folded label 41 with the protruding portion 47*a* side facing backward in the rotation direction K of the adsorption drum 22 and with the folding line 43 side facing forward in the rotation direction K of the adsorption drum 22 will be adsorbed by the adsorption drum 22.

Fourth Embodiment

Figure 14:
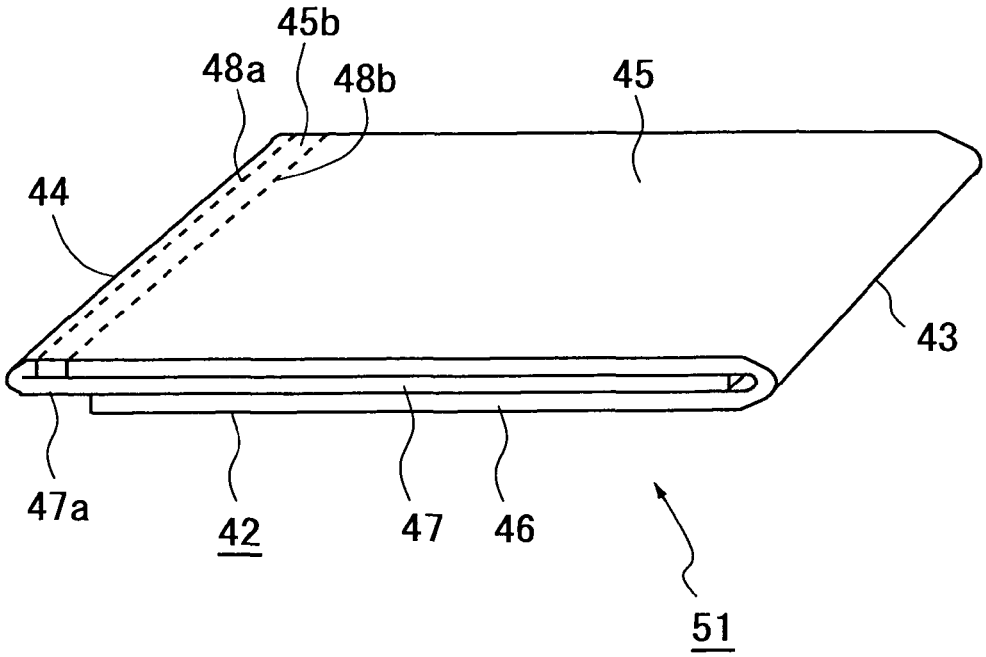
FIG. 14 is a schematic perspective view showing a folded label according to a fourth embodiment of the present invention.
Figure 15:
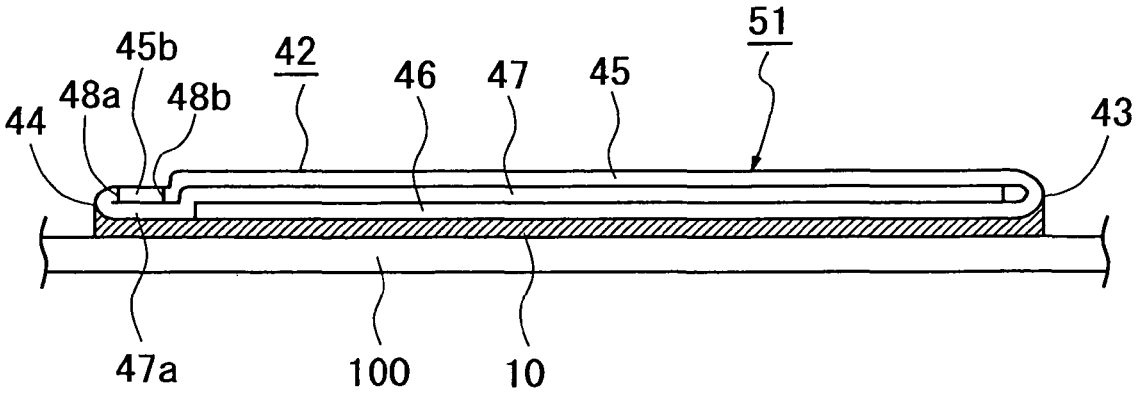
FIG. 15 is a schematic cross-sectional view showing a state that the folded label shown in FIG. 14 is attached to a bag.

FIG. 14 is a schematic perspective view showing a folded label 51 according to a fourth embodiment of the present invention. FIG. 14 corresponds to FIG. 10. FIG. 15 is a schematic cross-sectional view showing a state that the folded label 51 according to the present embodiment is attached to a bag 100. FIG. 15 corresponds to FIG. 12. In FIGS. 14 and 15, components identical or corresponding to those in FIGS. 10 and 12 are designated by the same reference numerals, and repetitive description thereon is omitted.

The folded label 51 according to the present embodiment differs from the folded label 41 shown in FIGS. 10 to 13 only in that perforated lines 48*a* and 48*b* are formed near a folding line 44.

The present embodiment also provides similar advantages to those of the third embodiment.

Fifth Embodiment

Figure 16:
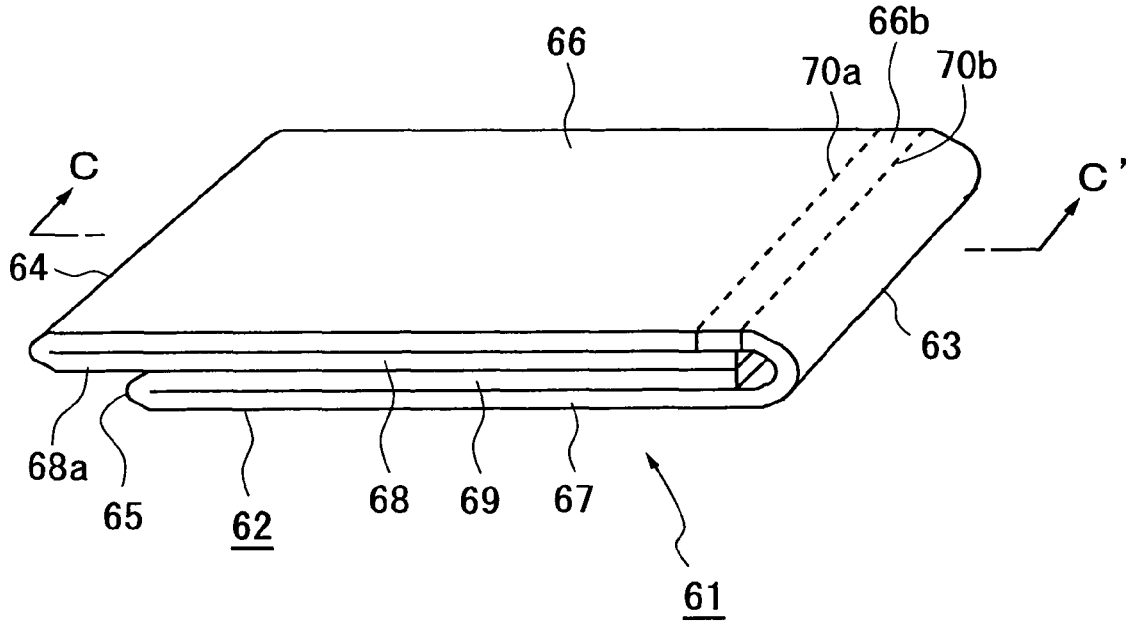
FIG. 16 is a schematic perspective view showing a folded label according to a fifth embodiment of the present invention.
Figure 17:
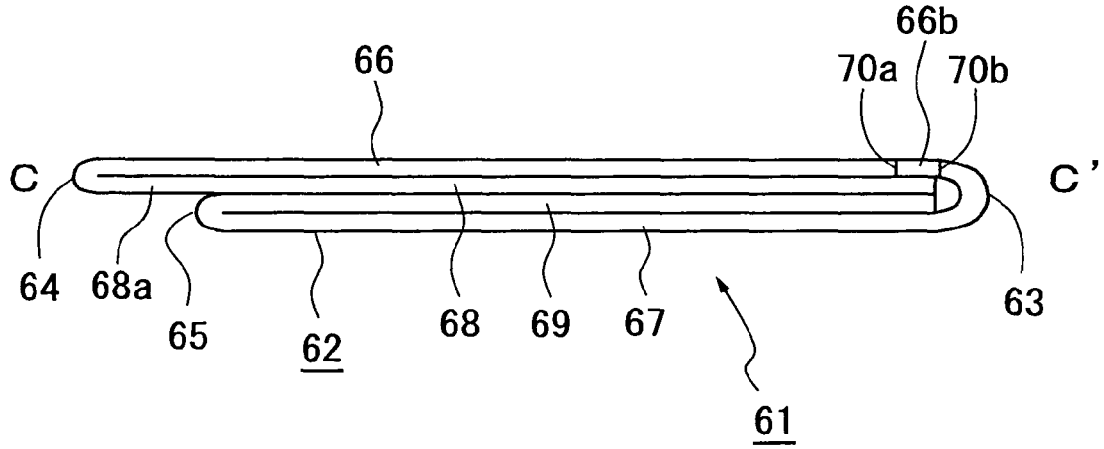
FIG. 17 is a schematic cross-sectional view taken along a line C-C' in FIG. 16.

FIG. 16 is a schematic perspective view showing a folded label 61 according to a fifth embodiment of the present invention. FIG. 17 is a schematic cross-sectional view taken along a line C-C' in FIG. 16.

This folded label 61 uses only one sheet 62 having display contents (not shown) described on predetermined portions on both surface sides thereof. The folded label 61 is formed by folding the sheet 62 without any portions of the sheet 62 adhered to each other.

Among four sheet sections 66, 67, 68 and 69 superposed over each other each into which the sheet is partitioned by three folding lines 63, 64 and 65, the first and second sheet sections 66 and 67 adjacent and continuous to each other through the first folding line 63 appear on upper and lower surface sides of the folded label 61, respectively, when the folded label 61 is folded. The third sheet section 68 is adjacent and continuous to the first sheet section 66 through the second folding line 64. The first and second folding lines 63 and 64 are located in opposite sides of the first sheet section 66.

Only the first sheet section 66 appears on the upper surface side of the folded label 61. The second sheet section 67 and only one part of the third sheet section 68 constituting a protruding portion 68*a* protruding from the second sheet section 67 on a side opposite to the side of the first folding line 63 appear on the lower surface side of the folded label 61.

Two perforated lines 70*a* and 70*b* for separating the first sheet section 66 into parts on sides of the first folding line 63 and the second folding line 64 are formed on the first sheet section 66. In the present embodiment, the two perforated lines 70*a* and 70*b* form a zonal tear-off portion 66*b* in the first sheet section 66. It is a matter of course that only one perforated line 70*a* may be formed instead. Even in this case, the first sheet section 66 can be separated into parts by cutting along the perforated line 70*a*. Although the perforated lines 70*a* and 70*b* are formed near the folding line 63 in the present embodiment, positions where the perforated lines 70*a* and 70*b* are formed are not particularly limited as long as they are positions where the first sheet section 66 can be separated into parts on sides of the first folding line 63 and the second folding line 64.

A sheet of any one of various materials can be used as the sheet 62, similarly to the aforementioned sheet 2.

Although the display contents are described by printing etc. in an area except for the lower surface of the protruding portion 68*a* and the lower surface of the sheet section 67 in the present embodiment, illustration of the display contents is omitted.

Figure 18:
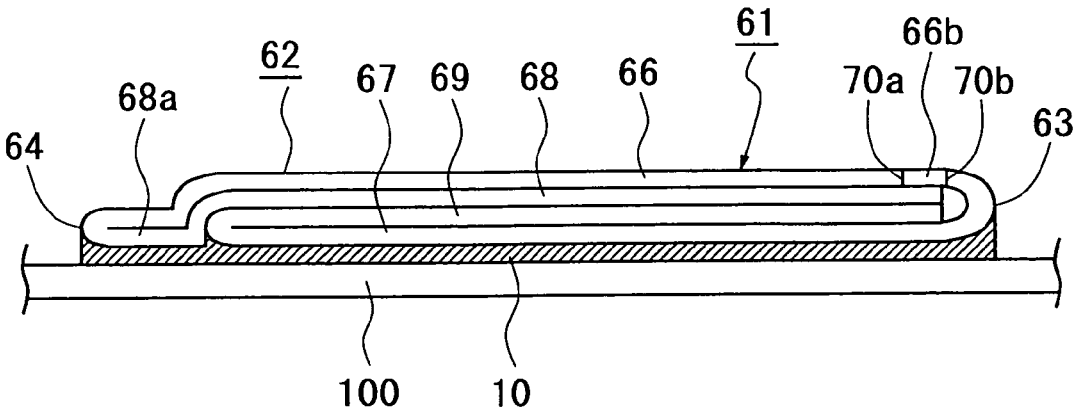
FIG. 18 is a schematic cross-sectional view showing a state that the folded label shown in FIG. 16 is attached to a bag.

FIG. 18 is a schematic cross-sectional view showing a state that the folded label 61 according to the present embodiment is attached to a bag 100 such as a rectangular-bottomed bag which is a container as an article. FIG. 18 corresponds to FIG. 17.

When this folded label 61 is attached to the article such as the bag 100 as shown in FIG. 18, the lower surface of the protruding portion 68*a* and the lower surface of the second sheet section 67 are adhered to the bag 100 by an adhesive 10.

Since the folded label 61 according to the present embodiment is formed without any portions of the sheet 62 adhered to each other, the respective sheet sections 66, 67, 68 and 69 are not particularly kept in a folded state before the folded label 61 is adhered to the article such as the bag 100 (see FIG. 16 and FIG. 17). As it is understandable from FIG. 18, the respective sheet sections 66, 67, 68 and 69 are however kept in a folded state after the lower surface of the protruding portion 68*a* and the lower surface of the second sheet section 67 are adhered to the article such as the bag 100.

Figure 19:
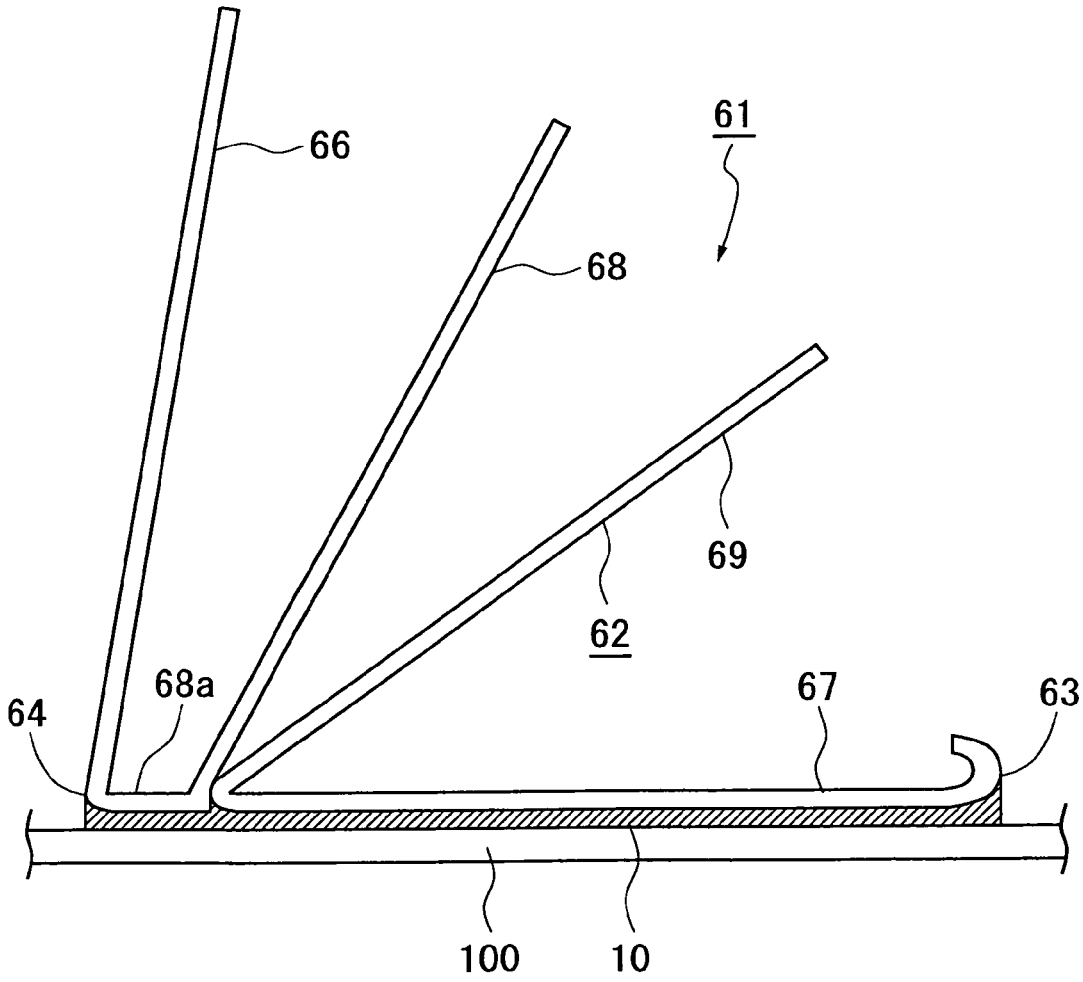
FIG. 19 is a schematic cross-sectional view showing a state that the folded label shown in FIG. 16 and attached to the bag is unfolded.

When a consumer or the like wants to watch the whole display contents of the folded label 61, the consumer or the like can unfold the folded label 61 easily, as shown in FIG. 19, by tearing off the tear-off portion 66*b* along the perforated lines 70*a* and 70*b*. FIG. 19 is a schematic cross-sectional view showing a state that the folded label 61 attached to the bag 100 is unfolded. FIG. 19 corresponds to FIG. 18.

As described above, the folded label 61 according to the present embodiment uses only one sheet 62 and is formed by folding the sheet 62. However, none of portions of the sheet 62 adhered to each other. Accordingly, the production process becomes simple and cost can be reduced because it is not necessary to use a production apparatus which can perform application of an adhesive.

The article with a folded label (the bag 100 including folded labels 61 attached thereto in the present embodiment) shown in FIG. 18 can be produced in a manner similar to the aforementioned article with a folded label shown in FIG. 4. When the labeling machine shown in FIG. 6 is used for sticking the folded labels 61 on the bags 100, the folded labels 61 are set in the magazine 21 so that each folded label 61 with the second sheet section 67 facing outward and with the first sheet section 66 facing inward will be adsorbed by the adsorption drum 22 while the folded label 61 with the protruding portion 68*a* side facing backward in the rotation direction K of the adsorption drum 22 and with the folding line 63 side facing forward in the rotation direction K of the adsorption drum 22 will be adsorbed by the adsorption drum 22.

Sixth Embodiment

Figure 20:
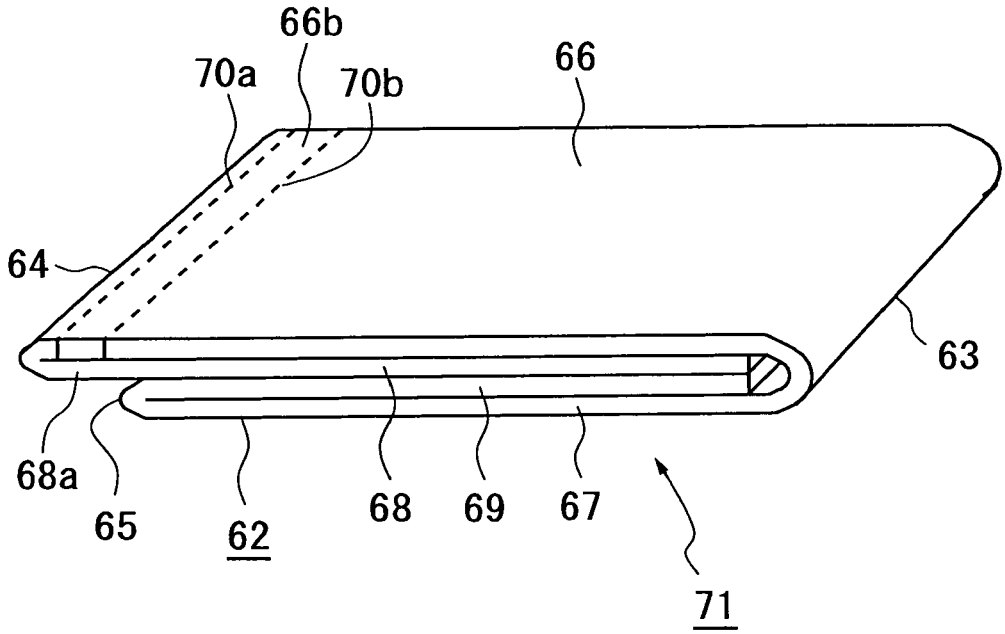
FIG. 20 is a schematic perspective view showing a folded label according to a sixth embodiment of the present invention.
Figure 21:
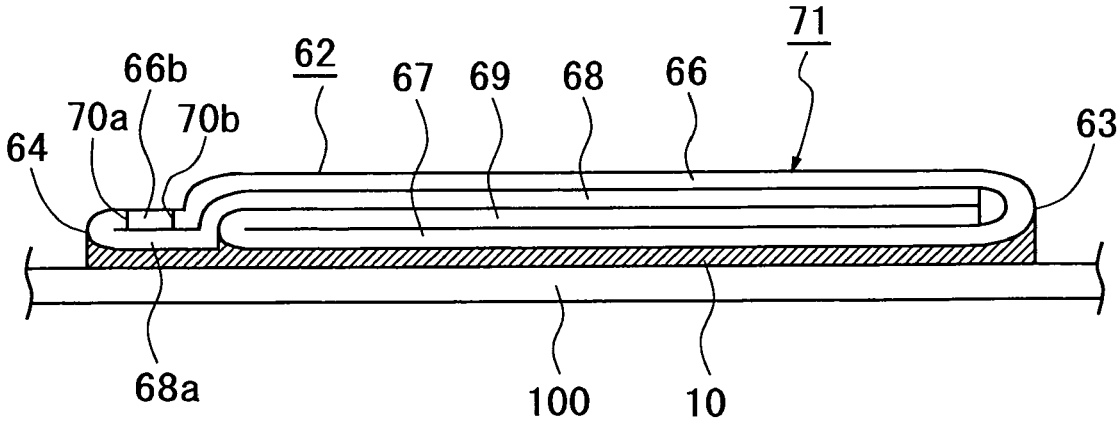
FIG. 21 is a schematic cross-sectional view showing a state that the folded label shown in FIG. 20 is attached to a bag.

FIG. 20 is a schematic perspective view showing a folded label 71 according to a sixth embodiment of the present invention. FIG. 20 corresponds to FIG. 16. FIG. 21 is a schematic cross-sectional view showing a state that the folded label 71 according to the present embodiment is attached to a bag 100. FIG. 21 corresponds to FIG. 18. In FIGS. 20 and 21, components identical or corresponding to those in FIGS. 16 and 18 are designated by the same reference numerals, and repetitive description thereon is omitted.

The folded label 71 according to the present embodiment differs from the folded label 61 shown in FIGS. 16 to 19 only in that perforated lines 70*a* and 70*b* are formed near a folding line 64.

The present embodiment also provides similar advantages to those of the fifth embodiment.

Seventh Embodiment

Figure 22:
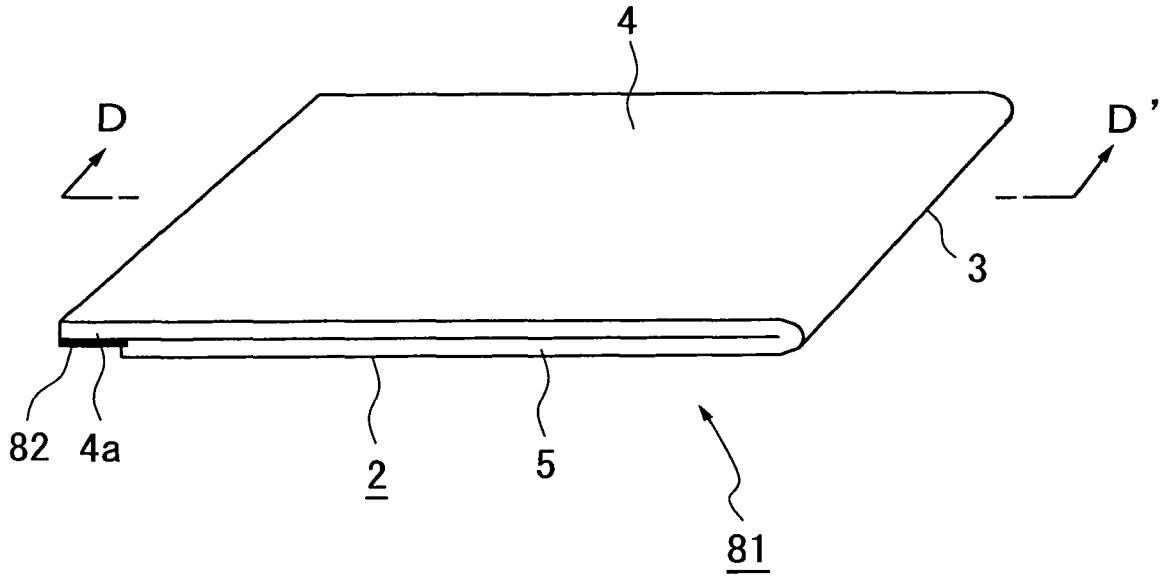
FIG. 22 is a schematic perspective view showing a folded label according to a seventh embodiment of the present invention.
Figure 23:
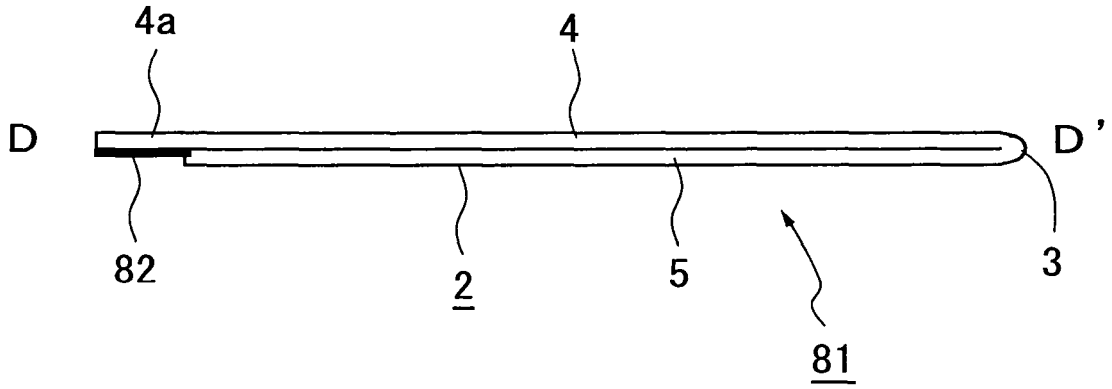
FIG. 23 is a schematic cross-sectional view taken along a line D-D' in FIG. 22.
Figure 24:
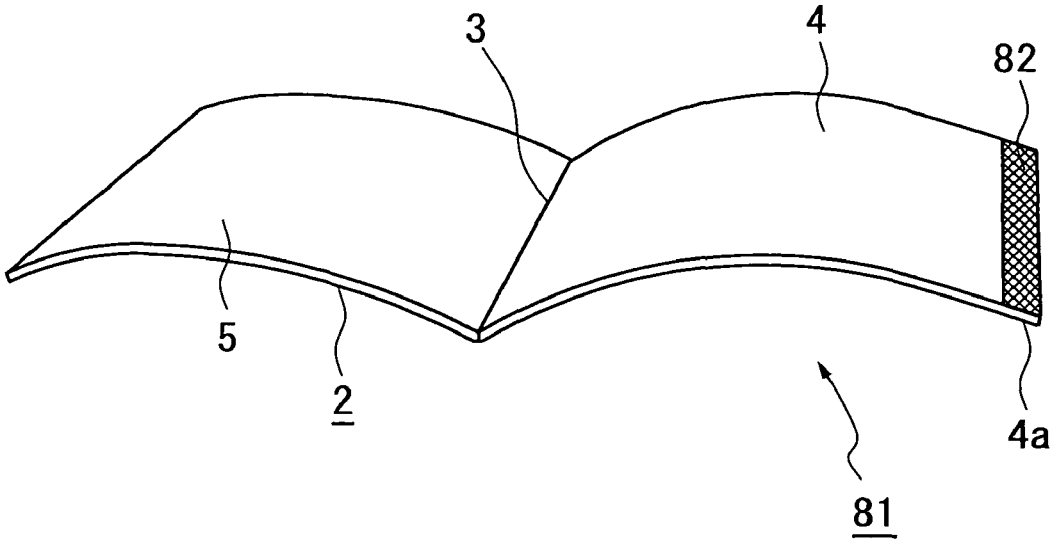
FIG. 24 is a schematic expansion view prior to folding, showing the folded label shown in FIG. 22.

FIG. 22 is a schematic perspective view showing a folded label 81 according to a seventh embodiment of the present invention. FIG. 22 corresponds to FIG. 1. FIG. 23 is a schematic cross-sectional view taken along a line D-D' in FIG. 22. FIG. 24 is a schematic expansion view prior to folding, showing the folded label 81 according to the present embodiment. In FIGS. 22 to 24, components identical or corresponding to those in FIGS. 1 to 3 are designated by the same reference numerals, and repetitive description thereon is omitted.

The folded label 81 according to the present embodiment differs from the folded label 1 shown in FIGS. 1 to 3 only in that the perforated lines 6*a* and 6*b* are not formed but a release agent 82 is formed on the lower surface of the protruding portion 4*a* instead.

The release agent 82 is an agent which weakens the adhesive strength of an adhesive 10 at the time of adhering with the adhesive 10 so as to make release easily. For example, a release varnish (e.g. "release OP varnish" made by DIC Corporation in Japan) etc. may be an example of the release agent. The release agent can be formed in advance, for example, by printing etc. This point can also apply to respective embodiments which will be described later.

Figure 25:
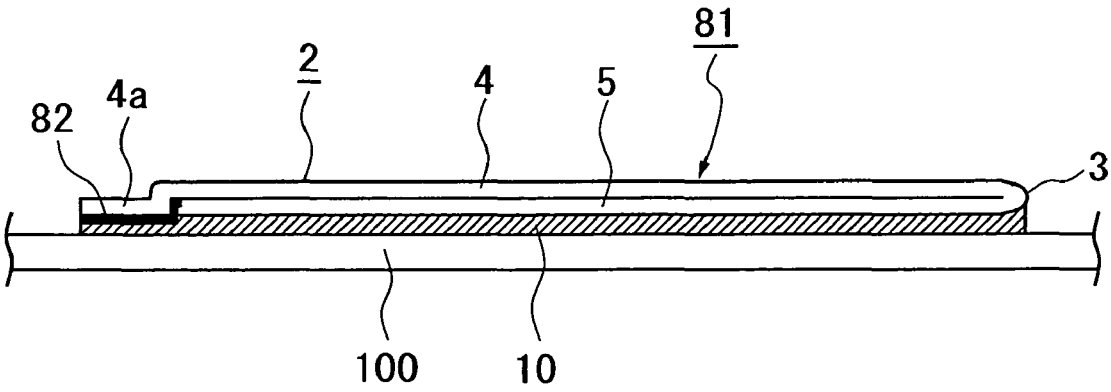
FIG. 25 is a schematic cross-sectional view showing a state that the folded label shown in FIG. 22 is attached to a bag.

FIG. 25 is a schematic cross-sectional view showing a state that the folded label 81 according to the present embodiment is attached to a bag 100 such as a rectangular-bottomed bag which is a container as an article. FIG. 25 corresponds to FIG. 23.

Since the folded label 81 according to the present embodiment is formed without any portions of the sheet 2 adhered to each other, the respective sheet sections 4 and 5 are not particularly kept in a folded state before the folded label 81 is adhered to the article such as the bag 100 (see FIG. 22 and FIG. 23). As it is understandable from FIG. 25, the respective sheet sections 4 and 5 are however kept in a folded state after the lower surface of the protruding portion 4*a* and the lower surface of the second sheet section 5 are adhered to the article such as the bag 100.

Figure 26:
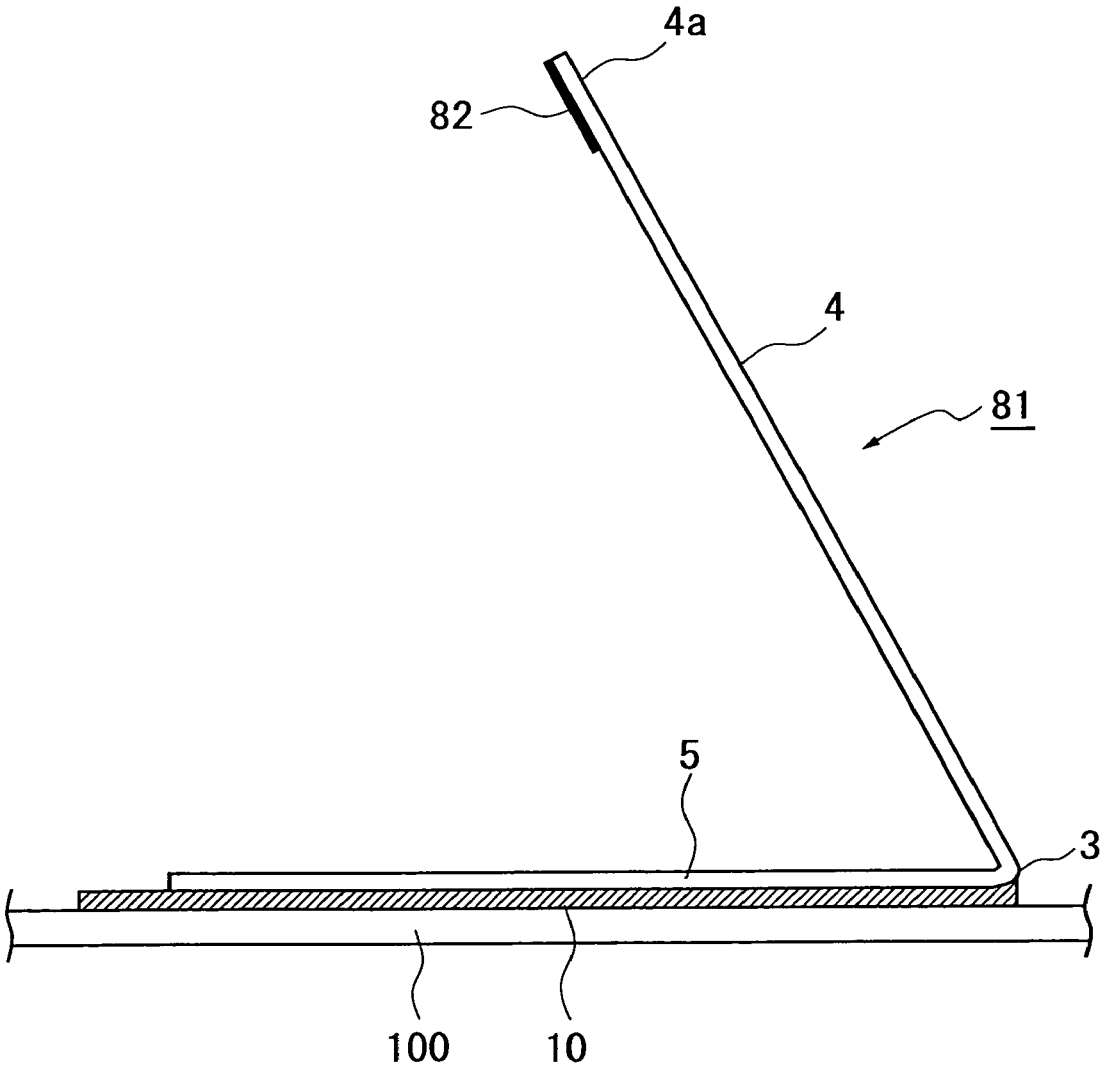
FIG. 26 is a schematic cross-sectional view showing a state that the folded label shown in FIG. 22 and attached to the bag is unfolded.

Since the release agent 82 is formed on the lower surface of the protruding portion 4*a*, the protruding portion 4*a* is adhered to the bag 100 by the adhesive 10 through the release agent 82, so that the adhesion strength of the adhesive 10 in the protruding portion 4*a* is comparatively weak. Accordingly, the protruding portion 4*a* can be released from the bag 100 comparatively easily. When a consumer or the like wants to watch the whole display contents of the folded label 81, the consumer or the like can unfold the folded label 81 easily, as shown in FIG. 26, by releasing the protruding portion 4*a* from the bag 100. FIG. 26 is a schematic cross-sectional view showing a state that the folded label 81 attached on the bag 100 is unfolded. FIG. 26 corresponds to FIG. 25.

The present embodiment also provides similar advantages to those of the first embodiment.

The article with a folded label (the bag 100 including the folded label 81 attached thereto in the present embodiment) shown in FIG. 25 can be produced in a manner similar to the aforementioned article with a folded label shown in FIG. 4.

Eighth Embodiment

Figure 27:
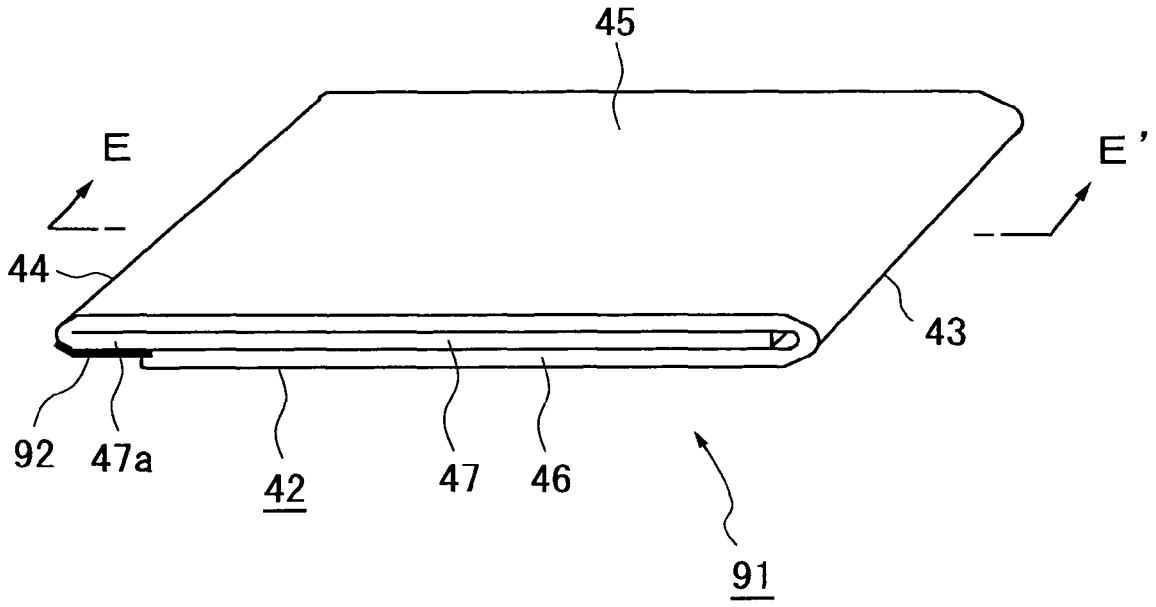
FIG. 27 is a schematic perspective view showing a folded label according to an eighth embodiment of the present invention.
Figure 28:
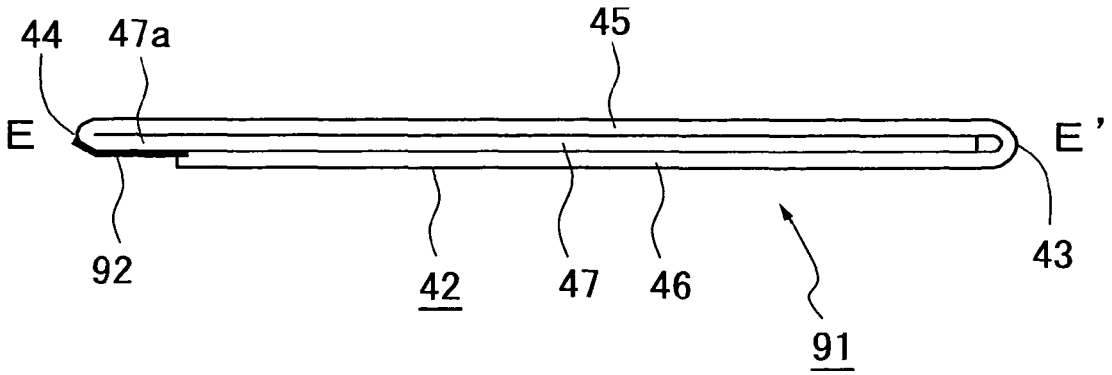
FIG. 28 is a schematic cross-sectional view taken along a line E-E' in FIG. 27.

FIG. 27 is a schematic perspective view showing a folded label 91 according to an eighth embodiment of the present invention. FIG. 27 corresponds to FIG. 10. FIG. 28 is a schematic cross-sectional view taken along a line E-E' in FIG. 27. In FIGS. 27 and 28, components identical or corresponding to those in FIGS. 10 and 11 are designated by the same reference numerals, and repetitive description thereon is omitted.

The folded label 91 according to the present embodiment differs from the folded label 41 shown in FIGS. 10 and 11 only in that perforated lines 48*a* and 48*b* are not formed but a release agent 92 is formed on the lower surface of a protruding portion 47*a* instead.

Figure 29:
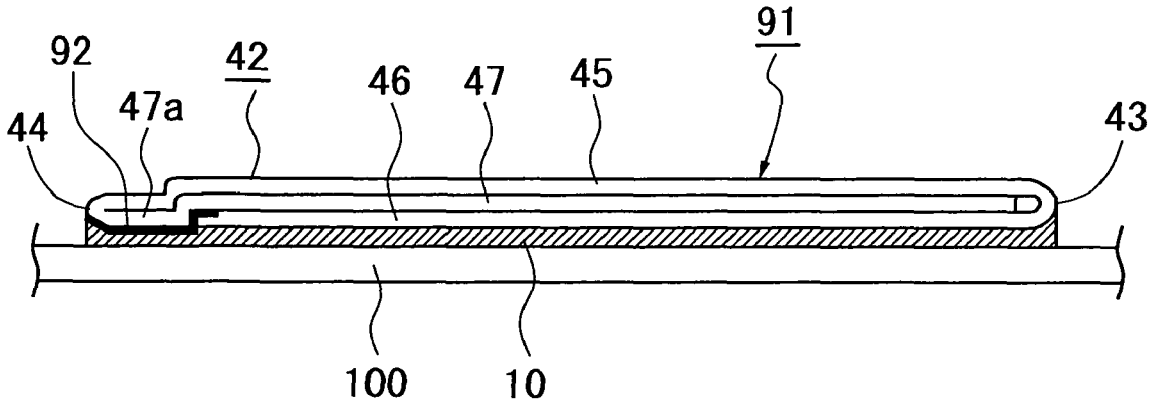
FIG. 29 is a schematic cross-sectional view showing a state that the folded label shown in FIG. 27 is attached to a bag.

FIG. 29 is a schematic cross-sectional view showing a state that the folded label 91 according to the present embodiment is attached on a bag 100 such as a rectangular-bottomed bag which is a container as an article. FIG. 29 corresponds to FIG. 28.

Since the folded label 91 according to the present embodiment is formed without any portions of the sheet 42 adhered to each other, the respective sheet sections 45, 46 and 47 are not particularly kept in a folded state before the folded label 91 is adhered to the article such as the bag 100 (see FIG. 27 and FIG. 28). As it is understandable from FIG. 29, the respective sheet sections 45, 46 and 47 are however kept in a folded state after the lower surface of the protruding portion 47*a* and a lower surface of the second sheet section 46 are adhered to the article such as the bag 100.

Since the release agent 92 is formed on the lower surface of the protruding portion 47*a*, the protruding portion 47*a* is adhered to the bag 100 by an adhesive 10 through the release agent 92, so that the adhesion strength of adhesive 10 in the protruding portion 47*a* is comparatively weak. Accordingly, the protruding portion 47*a* can be released from the bag 100 comparatively easily. When a consumer or the like wants to watch the whole display contents of the folded label 91, the consumer or the like can unfold the folded label 91 easily by releasing the protruding portion 47*a* from the bag 100.

The present embodiment also provides similar advantages to those of the first embodiment.

The article with a folded label (the bag 100 including the folded label 91 attached thereto in the present embodiment) shown in FIG. 29 can be produced in a manner similar to the aforementioned article with a folded label shown in FIG. 12.

Ninth Embodiment

Figure 30:
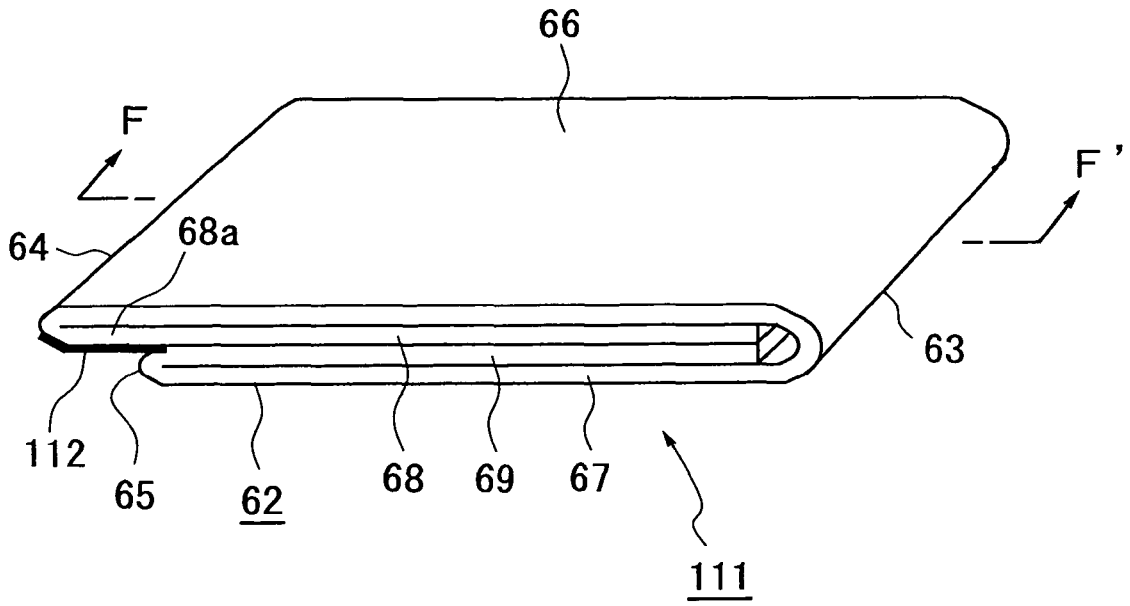
FIG. 30 is a schematic perspective view showing a folded label according to a ninth embodiment of the present invention.
Figure 31:
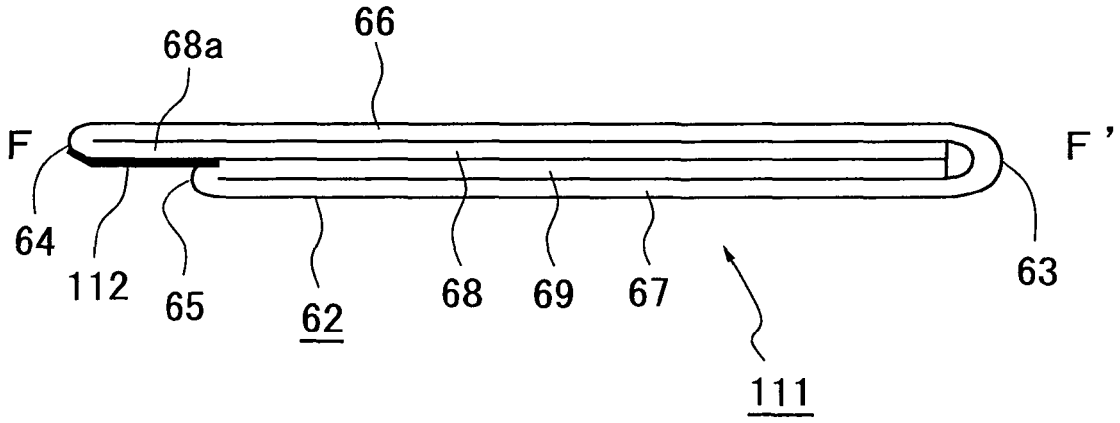
FIG. 31 is a schematic cross-sectional view taken along a line F-F' in FIG. 30.

FIG. 30 is a schematic perspective view showing a folded label 111 according to a ninth embodiment of the present invention. FIG. 30 corresponds to FIG. 16. FIG. 31 is a schematic cross-sectional view taken along a line F-F' in FIG. 30. In FIGS. 30 and 31, components identical or corresponding to those in FIGS. 16 and 17 are designated by the same reference numerals, and repetitive description thereon is omitted.

The folded label 111 according to the present embodiment differs from the folded label 61 shown in FIGS. 16 and 17 only in that perforated lines 70*a* and 70*b* are not formed but a release agent 112 is formed on a lower surface of a protruding portion 68*a* instead.

FIG. 29 is a schematic cross-sectional view showing a state that the folded label 91 according to the present embodiment is attached on a bag 100 such as a rectangular-bottomed bag which is a container as an article. FIG. 29 corresponds to FIG. 28.

Since the folded label 111 according to the present embodiment is formed without any portions of the sheet 62 adhered to each other, respective sheet sections 66, 67, 68 and 69 are not particularly kept in a folded state before the folded label 111 is adhered to the article such as the bag 100 (see FIG. 30 and FIG. 31). As it is understandable from FIG. 32, the respective sheet sections 66, 67, 68 and 69 are however kept in a folded state after the lower surface of the protruding portion 68*a* and a lower surface of the second sheet section 67 are adhered to the article such as the bag 100.

Since a release agent 112 is formed on the lower surface of the protruding portion 68*a*, the protruding portion 68*a* is adhered to the bag 100 by an adhesive 10 through the release agent 112, so that the adhesion strength of the adhesive 10 in the protruding portion 68*a* is comparatively weak. Accordingly, the protruding portion 68*a* can be released from the bag 100 comparatively easily. When a consumer or the like wants to watch the whole display contents of the folded label 111, the consumer or the like can unfold the folded label 111 easily by releasing the protruding portion 68*a* from the bag 100.

The present embodiment also provides similar advantages to those of the first embodiment.

Figure 32:
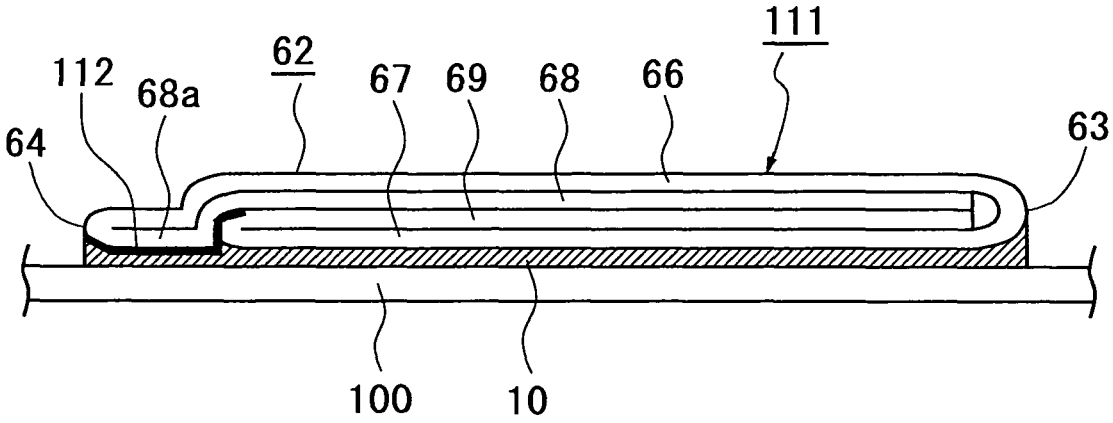
FIG. 32 is a schematic cross-sectional view showing a state that the folded label shown in FIG. 30 is attached to a bag.

The article with a folded label (the bag 100 including the folded label 111 attached thereto in the present embodiment) shown in FIG. 32 can be produced in a manner similar to the aforementioned article with a folded label shown in FIG. 18.

Tenth Embodiment

Figure 33:
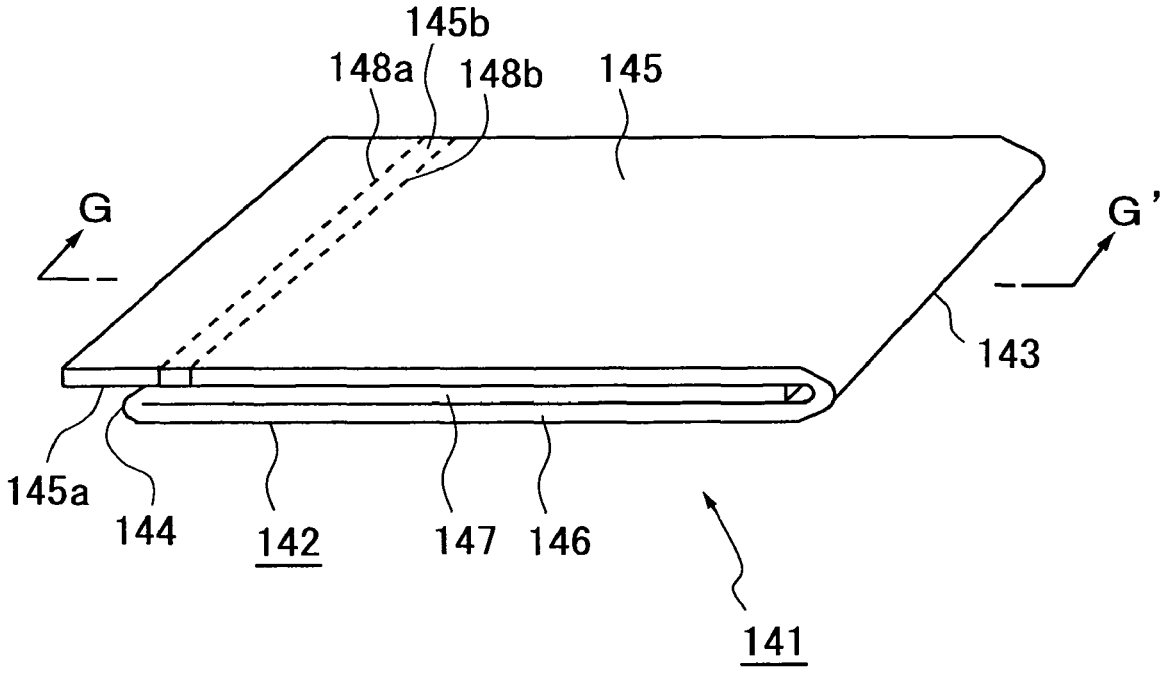
FIG. 33 is a schematic perspective view showing a folded label according to a tenth embodiment of the present invention.
Figure 34:
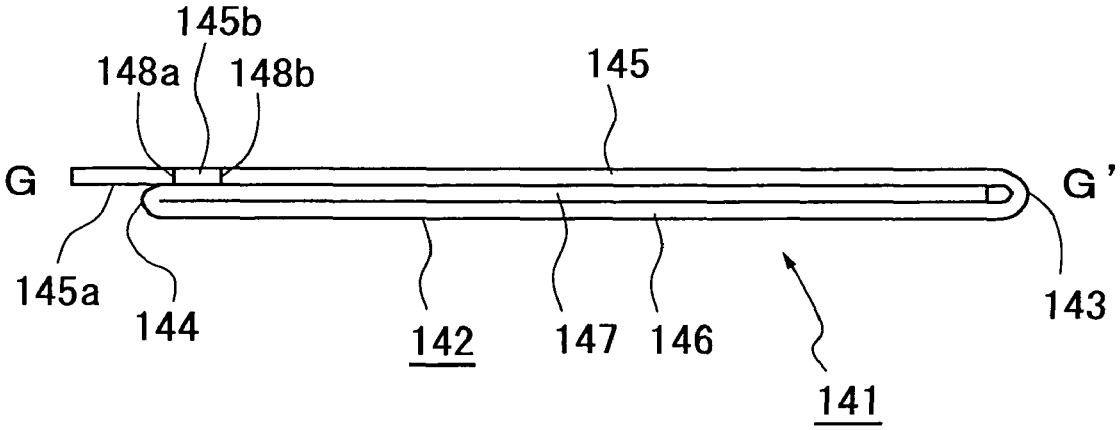
FIG. 34 is a schematic cross-sectional view taken along a line G-G' in FIG. 33.

FIG. 33 is a schematic perspective view showing a folded label 141 according to a tenth embodiment of the present invention. FIG. 34 is a schematic cross-sectional view taken along a line G-G' in FIG. 33.

This folded label 141 uses only one sheet 142 having display contents (not shown) described on predetermined portions on both surface sides thereof. The folded label 141 is formed by folding the sheet 142 without any portions of the sheet 142 adhered to each other.

Among three sheet sections 145, 146 and 147 superposed over each other each into which the sheet is partitioned by two folding lines 143 and 144, the first and second sheet sections 145 and 146 adjacent and continuous to each other through the first folding line 143 appear on upper and lower surface sides of the folded label 141, respectively, when the folded label 141 is folded. The third sheet section 147 is adjacent and continuous to the second sheet section 146 through the second folding line 144. The first and second folding lines 143 and 144 are located in opposite sides of the second sheet section 146.

Only the first sheet section 145 appears on the upper surface side of the folded label 141. The second sheet section 146 and only one part of the first sheet section 145 which constitutes a protruding portion 145*a* protruding from the second sheet section 146 on a side opposite to the side of the first folding line 143 appear on the lower surface side of the folded label 141.

Two perforated lines 148*a* and 148*b* for separating the first sheet section 145 into parts on sides of the first folding line 143 and the protruding portion 145*a* are formed on the first sheet section 145. In the present embodiment, the two perforated lines 148*a* and 148*b* form a zonal tear-off portion 145*b* in the first sheet section 145. It is a matter of course that only one perforated line 148*a* may be formed instead. Even in this case, the first sheet section 145 can be separated into parts by cutting along the perforated line 148*a*. Although the perforated lines 148*a* and 148*b* are formed near the protruding portion 145*a* in the present embodiment, positions where the perforated lines 148*a* and 148*b* are formed are not particularly limited as long as they are positions where the first sheet section 145 can be separated into parts on sides of the first folding line 143 and the protruding portion 145*a*.

A sheet of any one of various materials can be used as the sheet 142, similarly to the aforementioned sheet 2.

Although the display contents are described by printing etc. in an area except for the lower surface of the protruding portion 145*a* and the lower surface of the sheet section 146 in the present embodiment, illustration of the display contents is omitted.

Figure 35:
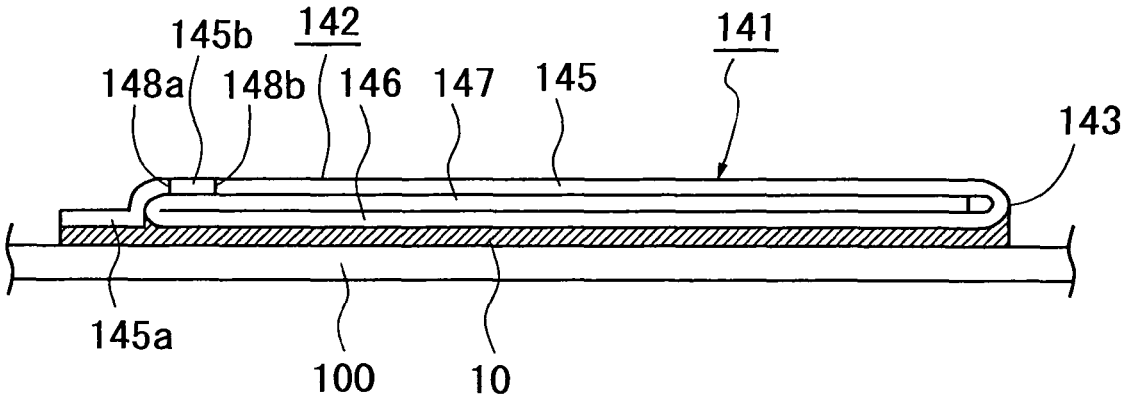
FIG. 35 is a schematic cross-sectional view showing a state that the folded label shown in FIG. 33 is attached to a bag.

FIG. 35 is a schematic cross-sectional view showing a state that the folded label 141 according to the present embodiment is attached on a bag 100 such as a rectangular-bottomed bag which is a container as an article. FIG. 35 corresponds to FIG. 34.

When this folded label 141 is attached to the article such as the bag 100 as shown in FIG. 35, the lower surface of the protruding portion 145*a* and the lower surface of the second sheet section 146 are adhered to the bag 100 by an adhesive 10.

Since the folded label 141 according to the present embodiment is formed without any portions of the sheet 142 adhered to each other, the respective sheet sections 145, 146 and 147 are not particularly kept in a folded state before the folded label 141 is adhered to the article such as the bag 100 (see FIG. 33 and FIG. 34). As it is understandable from FIG. 35, the respective sheet sections 145, 146 and 147 are however kept in a folded state after the lower surface of the protruding portion 145*a* and the lower surface of the second sheet section 146 are adhered to the article such as the bag 100.

When a consumer or the like wants to watch the whole display contents of the folded label 141, the consumer or the like can unfold the folded label 141 easily by tearing off the tear-off portion 145*b* along the perforated lines 148*a* and 148*b*.

As described above, the folded label 141 according to the present embodiment uses only one sheet 142 and is formed by folding the sheet 142. However, none of portions of the sheet 142 adhered to each other. Accordingly, the production process becomes simple and cost can be reduced because it is not necessary to use a production apparatus which can perform application of an adhesive.

The article with a folded label (the bag 100 including folded labels 141 attached thereon in the present embodiment) shown in FIG. 35 can be produced in a manner similar to the aforementioned article with a folded label shown in FIG. 4. When the labeling machine shown in FIG. 6 is used for sticking the folded labels 141 on the bags 100, the folded labels 141 are set in the magazine 21 so that each folded label 141 with the second sheet section 146 facing outward and with the first sheet section 145 facing inward will be adsorbed by the adsorption drum 22 while the folded label 141 with the protruding portion 145*a* side facing backward in a rotation direction K of the adsorption drum 22 and with the folding line 143 side facing forward in the rotation direction K of the adsorption drum 22 will be adsorbed by the adsorption drum 22.

Eleventh Embodiment

Figure 36:
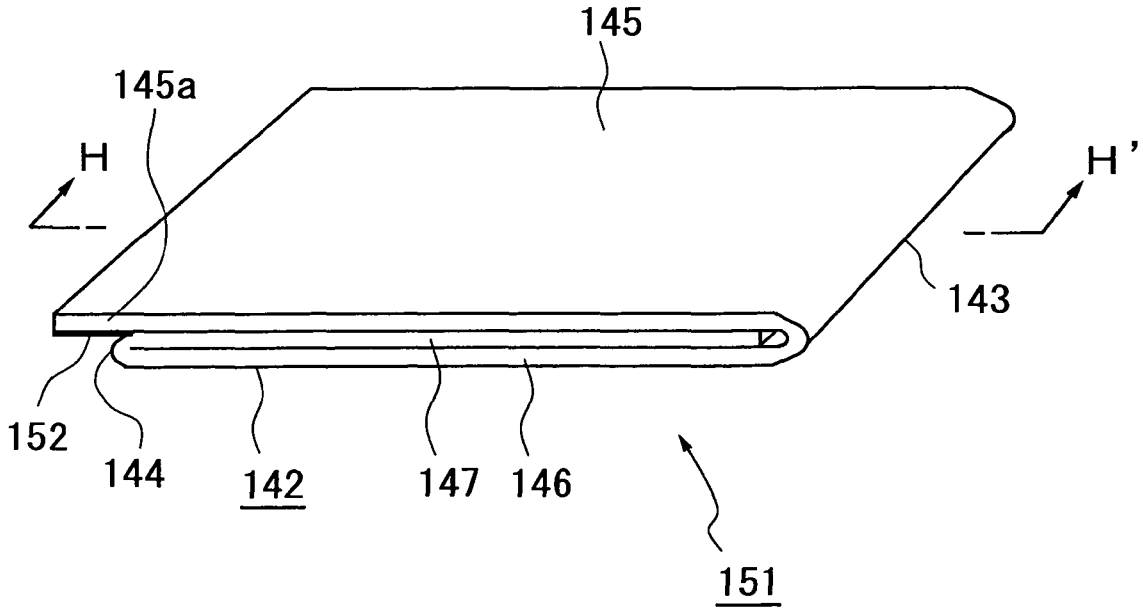
FIG. 36 is a schematic perspective view showing a folded label according to an eleventh embodiment of the present invention.
Figure 37:
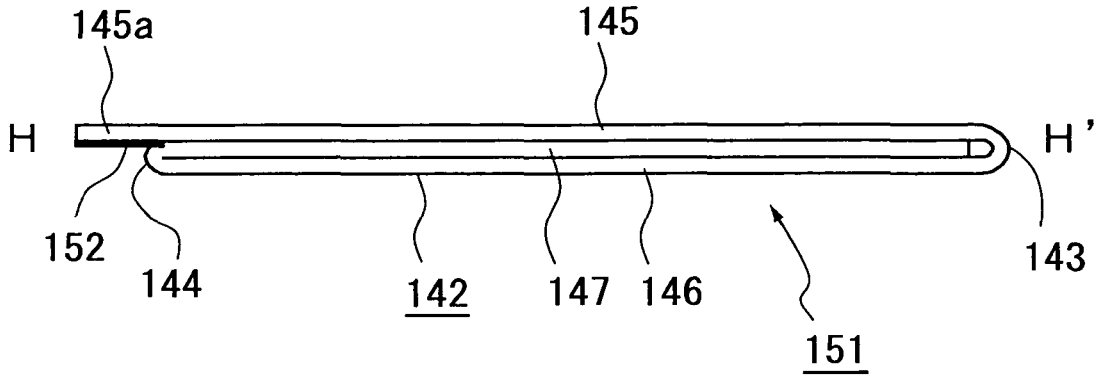
FIG. 37 is a schematic cross-sectional view taken along a line H-H' in FIG. 36.

FIG. 36 is a schematic perspective view showing a folded label 151 according to an eleventh embodiment of the present invention. FIG. 36 corresponds to FIG. 33. FIG. 37 is a schematic cross-sectional view taken along a line H-H' in FIG. 36. In FIGS. 36 and 37, components identical or corresponding to those in FIGS. 33 and 34 are designated by the same reference numerals, and repetitive description thereon is omitted.

The folded label 151 according to the present embodiment differs from the folded label 141 shown in FIGS. 33 and 34 only in that perforated lines 148*a* and 148*b* are not formed but a release agent 152 is formed on a lower surface of a protruding portion 145*a* instead.

Figure 38:
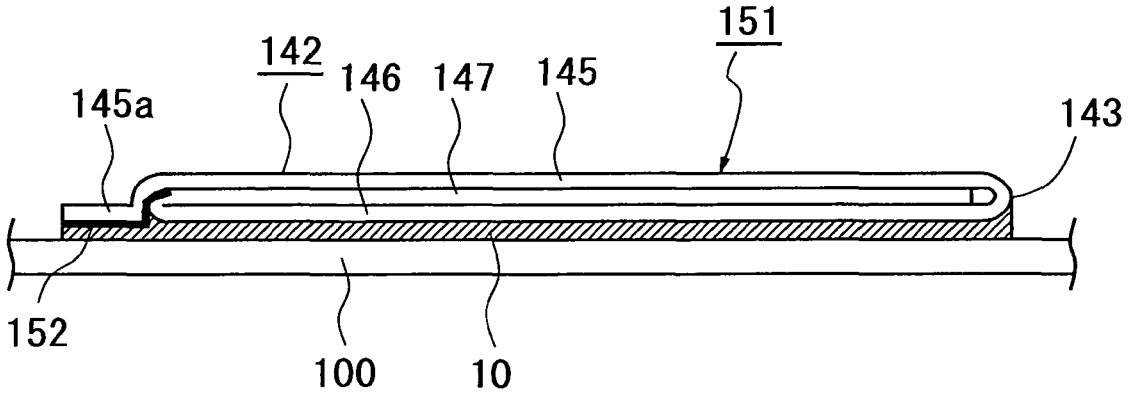
FIG. 38 is a schematic cross-sectional view showing a state that the folded label shown in FIG. 36 is attached to a bag.

FIG. 38 is a schematic cross-sectional view showing a state that the folded label 151 according to the present embodiment is attached on a bag 100 such as a rectangular-bottomed bag which is a container as an article. FIG. 38 corresponds to FIG. 35.

Since the folded label 151 according to the present embodiment is formed without any portions of the sheet 142 adhered to each other, the respective sheet sections 145, 146 and 147 are not particularly kept in a folded state before the folded label 151 is adhered to the article such as the bag 100 (see FIG. 36 and FIG. 37). As it is understandable from FIG. 38, the respective sheet sections 145, 146 and 147 are however kept in a folded state after the lower surface of the protruding portion 145*a* and a lower surface of the second sheet section 146 are adhered to the article such as the bag 100.

Since a release agent 152 is formed on the lower surface of the protruding portion 145*a*, the protruding portion 145*a* is adhered to the bag 100 by an adhesive 10 through the release agent 152, so that the adhesion strength of the adhesive 10 in the protruding portion 145*a* is comparatively weak. Accordingly, the protruding portion 145*a* can be released from the bag 100 comparatively easily. When a consumer or the like wants to watch the whole display contents of the folded label 151, the consumer or the like can unfold the folded label 151 easily by releasing the protruding portion 145*a* from the bag 100.

The present embodiment also provides similar advantages to those of the first embodiment.

The article with a folded label (the bag 100 including the folded label 151 attached thereto in the present embodiment) shown in FIG. 38 can be produced a manner similar to the aforementioned article with a folded label shown in FIG. 35.

Twelfth Embodiment

Figure 39:
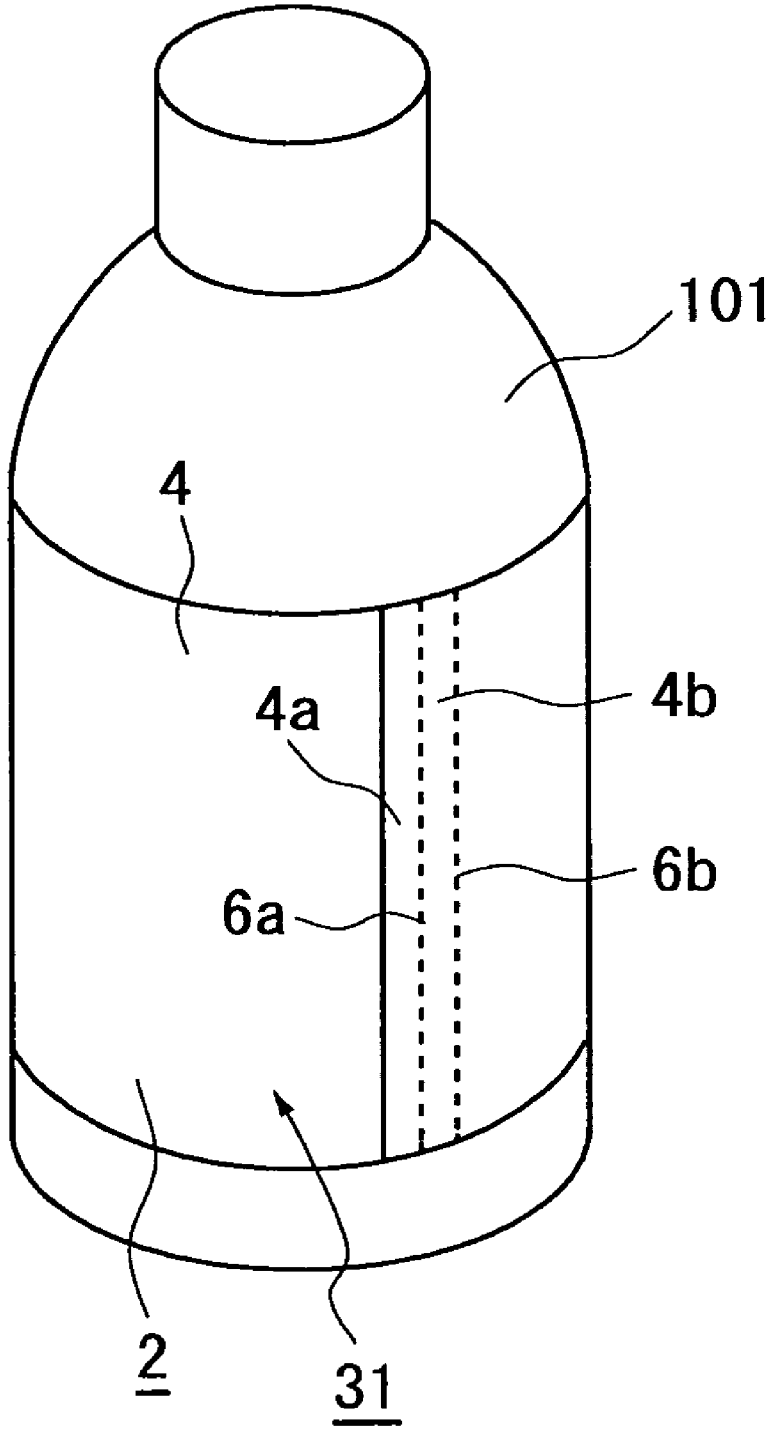
FIG. 39 is a schematic perspective view showing an article with a folded label according to a twelfth embodiment of the present invention.
Figure 40:
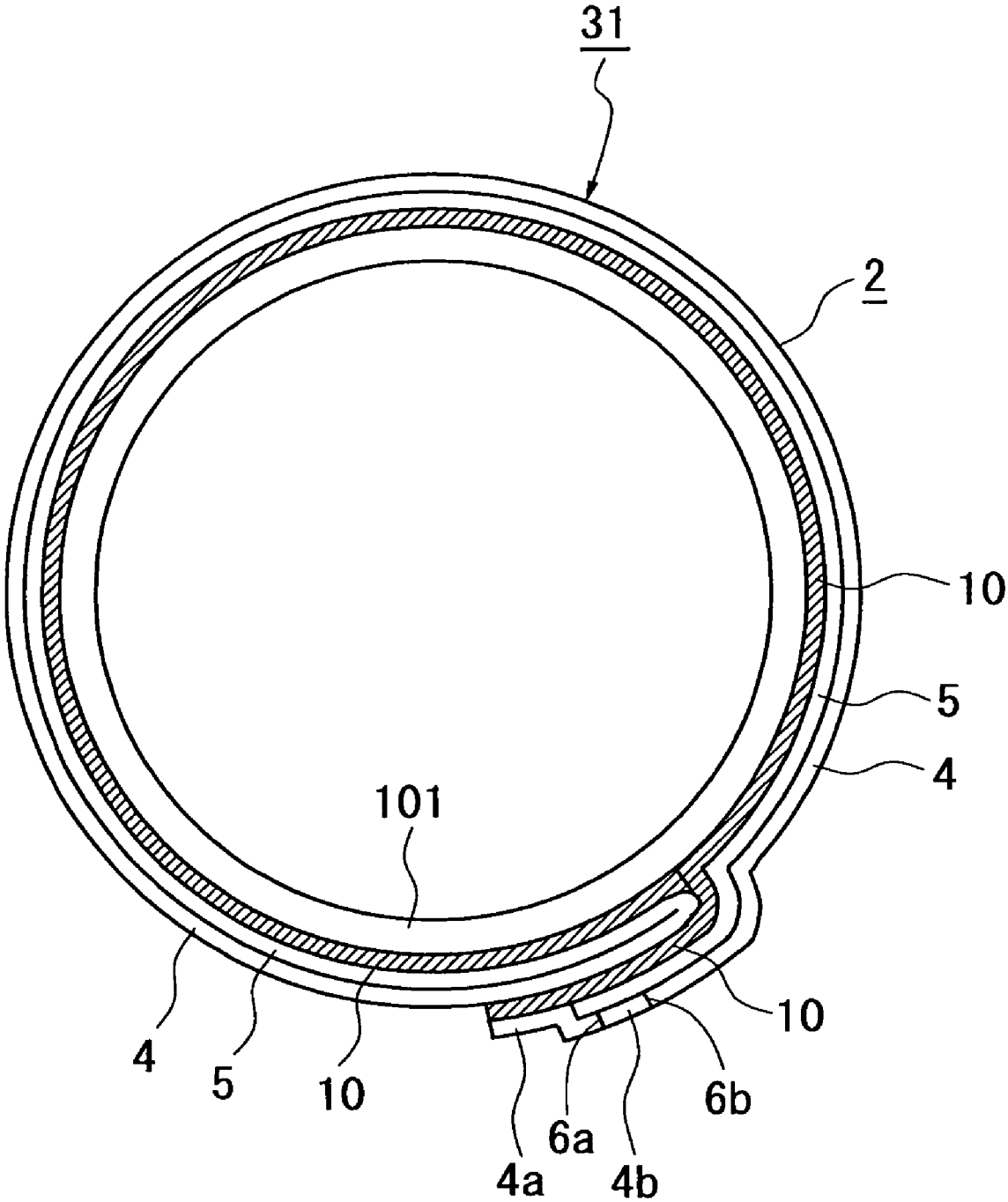
FIG. 40 is a schematic transverse cross-sectional view of the article with a folded label shown in FIG. 39.

FIG. 39 is a schematic perspective view showing an article with a folded label according to a twelfth embodiment of the present invention. FIG. 40 is a schematic transverse cross-sectional view of the article with a folded label shown in FIG. 39.

The article with a folded label according to the present embodiment is a bottle 101 to which the aforementioned folded label 31 shown in FIG. 8 is attached. As known from FIG. 40, a transverse length of the folded label 31 in FIG. 8 is set to be longer than one circumference of an outer circumferential surface of the bottle 101 in the present embodiment, but an excess part of the length over one circumference is set to be comparatively short.

In the present embodiment, the folded label 31 with the upper surface side facing outward in FIG. 8 and with the folding line 3 set as a winding initiation end portion is wound on the outer circumferential surface of a body portion of the bottle 101 so that the number of turns of the folded label 31 becomes more than one. An adhesive 10 is applied onto the whole of the lower surface of the folded label 31 in FIG. 8 so that the whole of the lower surface of the folded label 31 in FIG. 8 is adhered to opposite portions respectively.

The labeling machine shown in FIG. 6 can be fundamentally used for adhering the folded label 31 to the bottle 101 as in the present embodiment. However, the conveyer 26 can be changed properly in accordance with the bottle 101.

In the present embodiment, respective sheet sections 4 and 5 are kept in a folded state by the adhesive 10 as shown in FIGS. 39 and 40. When a consumer or the like wants to watch the whole display contents of the folded label 31, the consumer or the like can unfold the folded label 31 easily by tearing off a tear-off portion 4*b* along perforated lines 6*a* and 6*b*.

As described above, the folded label 31 according to the present embodiment uses only one sheet 2 and is formed by folding the sheet 2 without any portions of the sheet 2 adhered to each other. Accordingly, the production process becomes simple and cost can be reduced because it is not necessary to use a production apparatus which can perform application of an adhesive. In addition, the excess part of the folded label 31 over one circumference is adhered to the first circumference of the folded label 31 by the adhesive 10 in the present embodiment. Accordingly, even if the diameter of the outer circumference of the bottle 101 is small, there is no possibility that the respective sheet sections will be floating before the adhesive 10 is dried and hardened.

Thirteenth Embodiment

Figure 41:
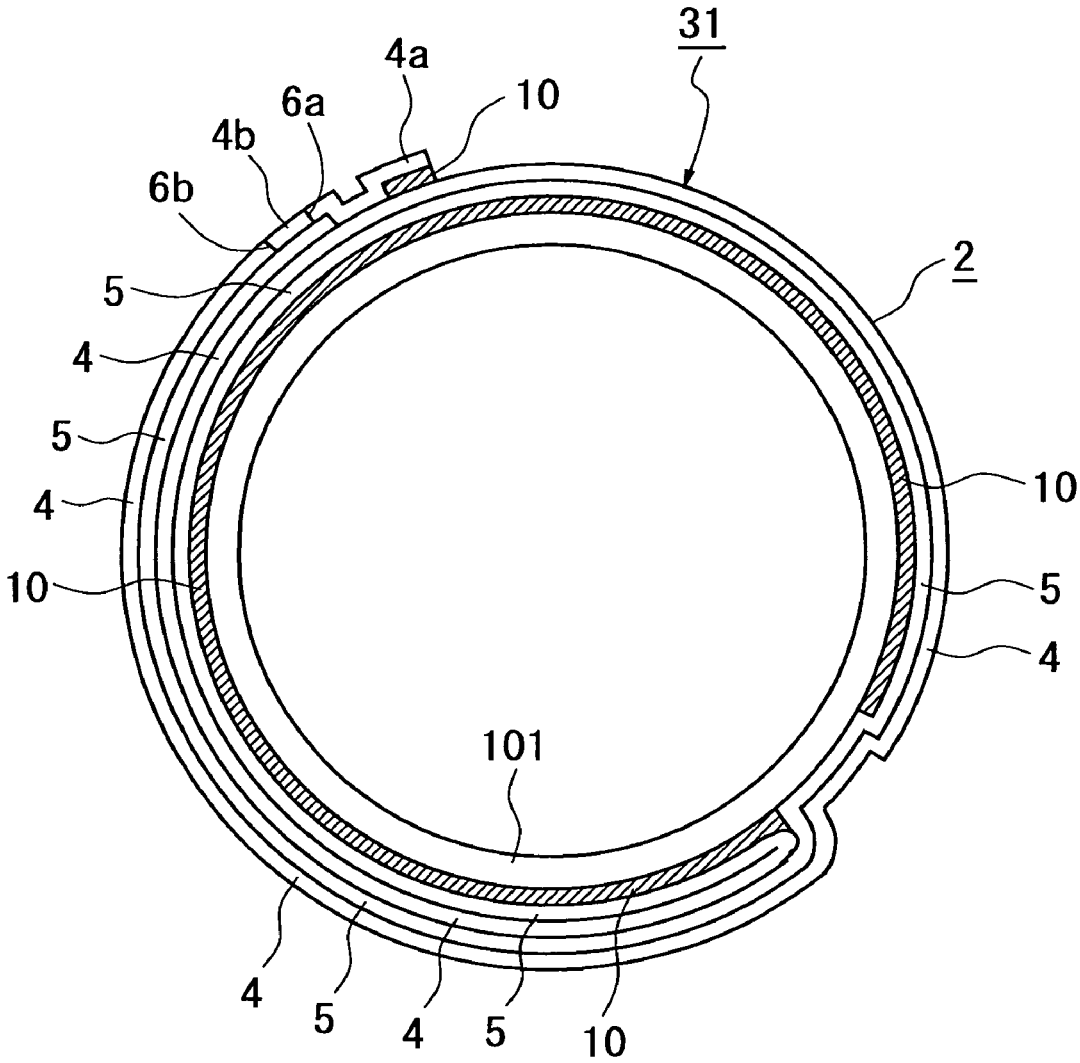
FIG. 41 is a schematic transverse cross-sectional view of an article with a folded label according to a thirteenth embodiment of the present invention.

FIG. 41 is a schematic transverse cross-sectional view of an article with a folded label according to a thirteenth embodiment of the present invention. FIG. 41 corresponds to FIG. 40. In FIG. 41, components identical or corresponding to those in FIG. 40 are designated by the same reference numerals, and repetitive description thereon is omitted.

The article with a folded label according to the present embodiment is also a bottle 101 to which the folded label 31 shown in FIG. 8 is attached in a manner similar to the article with a folded label according to the twelfth embodiment. The present embodiment differs from the twelfth embodiment only in the following two points. First, an excess part of the folded label 31 over the length of one circumference of the bottle 101 is set to be comparatively longer in such a manner that the folded label 31 is wound on the bottle 101 so that the number of turns of the folded label 31 becomes about 1.5. Second, a region coated with an adhesive 10 is not the whole of the lower surface of the folded label 31 in FIG. 8 but is limited to a region ranging from a folding line 3 to a position slightly shorter than one circumference of the bottle 101 and a region of a protruding portion 4*a*.

According to the present embodiment, not only is it possible to obtain similar advantages to those of the twelfth embodiment but it is also possible to obtain an advantage of greatly enlarging a region where display contents can be described due to the aforementioned two different points. In the present embodiment, display contents can be described in an outer surface of a sheet section 4 in the first circumference and an inner surface of a sheet section 5 in the second circumference in an overlapping region between the first and second circumferences of the folded label 31.

When the folded label 31 is formed to be longer in the present embodiment, the folded label 31 can be wound on the bottle 101 so that the number of turns of the folded label 31 becomes two or more.

For example, a folded label 51 shown in FIG. 14, a folded label 71 shown in FIG. 20 or a folded label 141 shown in FIGS. 33 and 34 may be used in place of the folded label 31 in the twelfth or thirteenth embodiment when the folded label is wound on the bottle 101 so that the number of turns of the folded label becomes more than one.

The labeling machine shown in FIG. 6 can be fundamentally used for adhering the folded label 31 to the bottle 101 as in the present embodiment. However, the conveyer 26 can be changed properly in accordance with the bottle 101. A coating roller having a concavoconvex shape fit to a region which will be coated with the adhesive 10 can be used as the coating roller 25.

Fourteenth Embodiment

Figure 42:
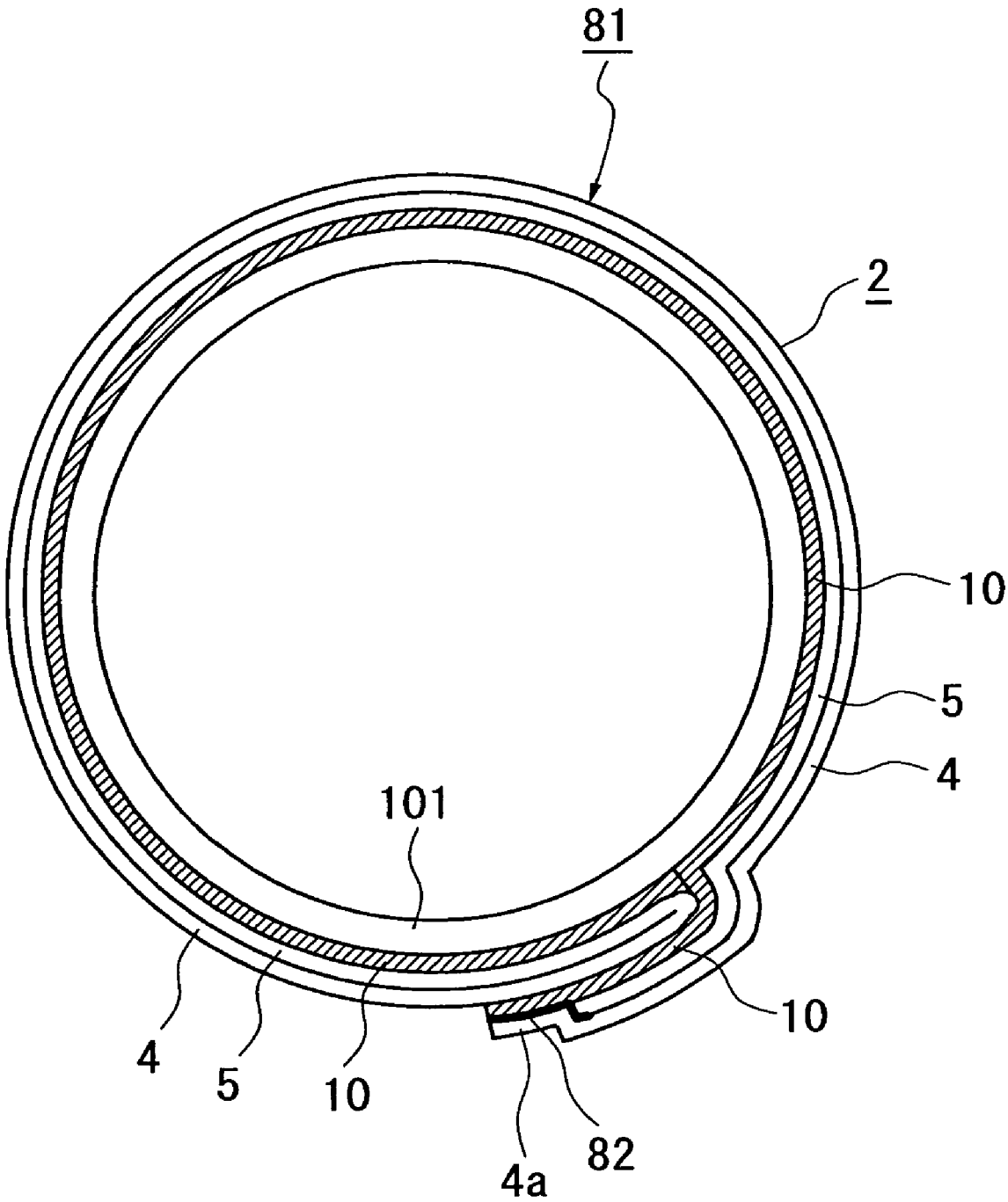
FIG. 42 is a schematic transverse cross-sectional view of an article with a folded label according to a fourteenth embodiment of the present invention.

FIG. 42 is a schematic cross-sectional transverse view of an article with a folded label according to a fourteenth embodiment of the present invention. FIG. 42 corresponds to FIG. 40. In FIG. 42, components identical or corresponding to those in FIG. 40 are designated by the same reference numerals, and repetitive description thereon is omitted.

The article with a folded label according to the present embodiment is a bottle 101 to which a folded label 81 shown in FIGS. 22 to 24 is attached in place of the folded label 31 shown in FIG. 8. However, the folded label 81 is wound on the bottle 101 so that the number of turns of the folded label 81 is more than one, in a manner similar to the twelfth embodiment.

The present embodiment also provides similar advantages to those of the twelfth embodiment.

Fifteenth Embodiment

Figure 43:
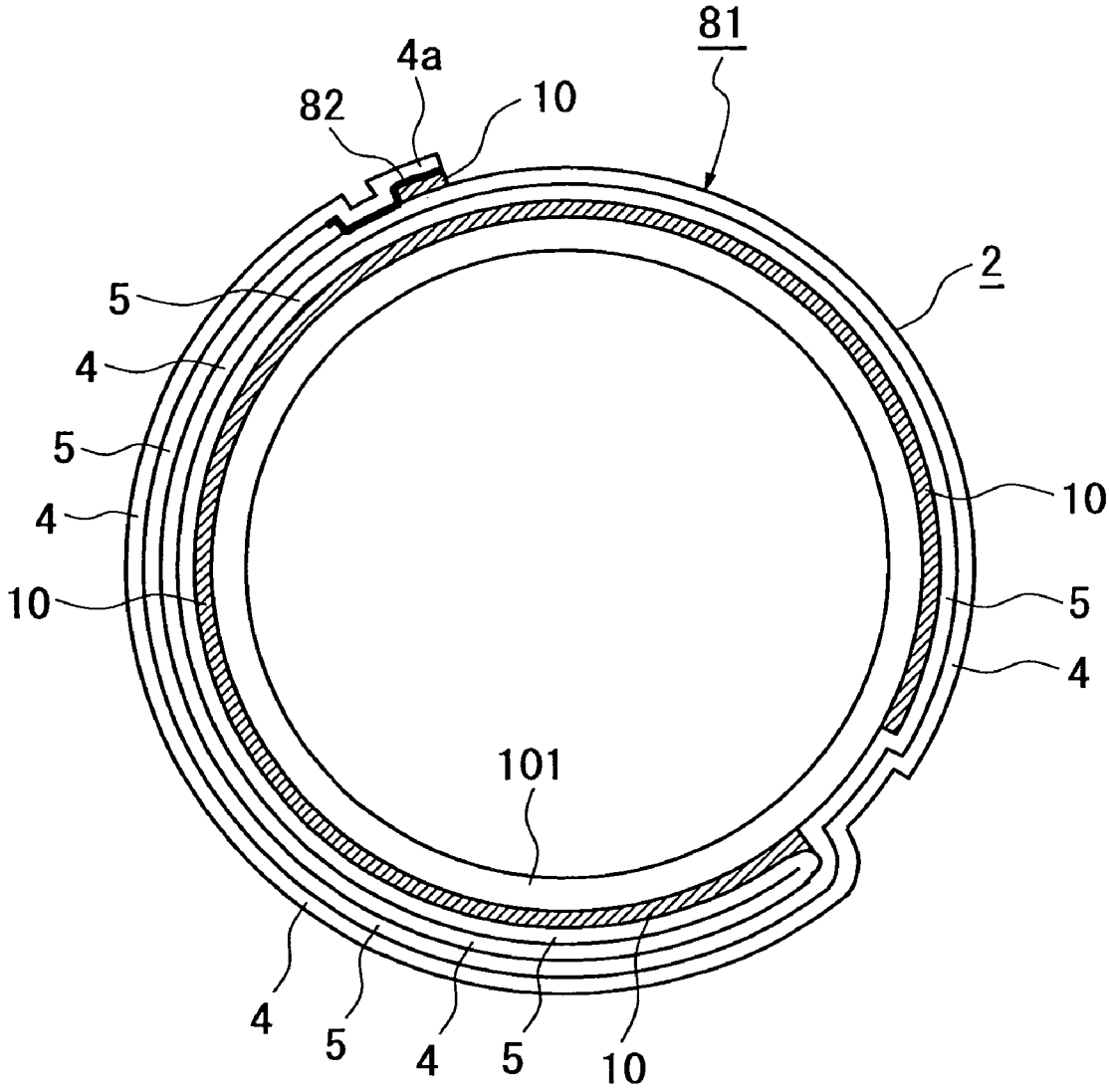
FIG. 43 is a schematic transverse cross-sectional view of an article with a folded label according to a fifteenth embodiment of the present invention.

FIG. 43 is a schematic transverse cross-sectional view of an article with a folded label according to a fifteenth embodiment of the present invention. FIG. 43 corresponds to FIG. 41. In FIG. 43, components identical or corresponding to those in FIG. 41 are designated by the same reference numerals, and repetitive description thereon is omitted.

The article with a folded label according to the present embodiment is a bottle 101 to which the folded label 81 shown in FIGS. 22 to 24 is attached in place of the folded label 31 shown in FIG. 8. However, the folded label 81 is wound on the bottle 101 so that the number of turns of the folded label 81 becomes more than one, in a manner similar to the thirteenth embodiment.

The present embodiment also provides similar advantages to those of the thirteenth embodiment.

For example, a folded label 91 shown in FIGS. 27 and 28, a folded label 111 shown in FIGS. 30 and 31 or a folded label 151 shown in FIGS. 36 and 37 may be used in place of the folded label 81 in the fourteenth or fifteenth embodiment when the folded label is wound on the bottle 101 so that the number of turns of the folded label becomes more than one.

Sixteenth Embodiment

Figure 44:
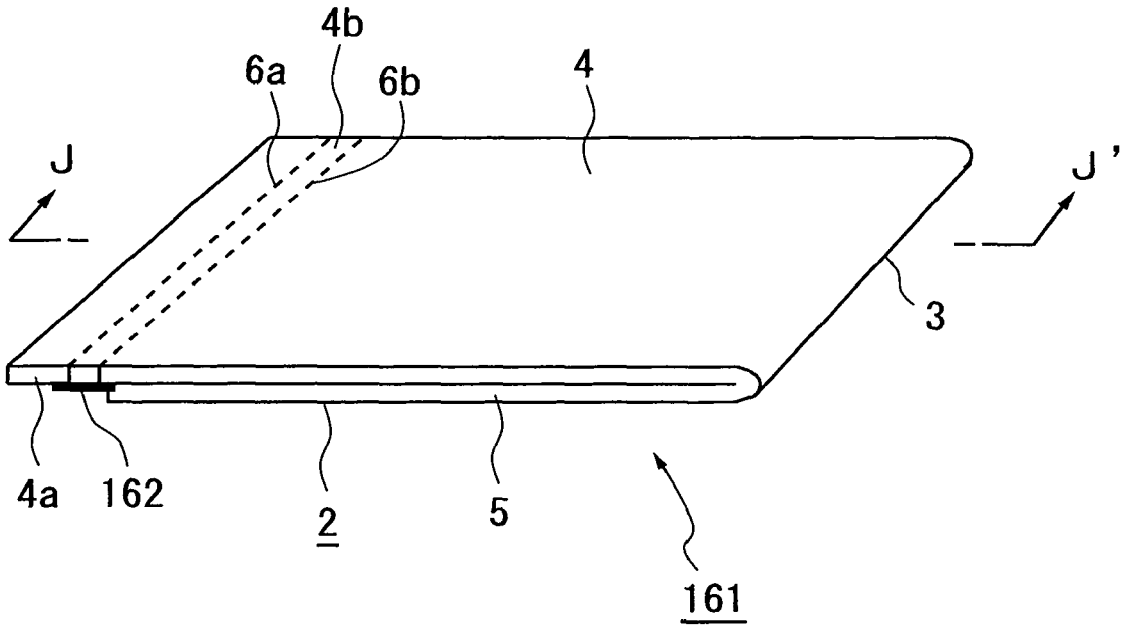
FIG. 44 is a schematic perspective view of a folded label according to a sixteenth embodiment of the present invention.
Figure 45:
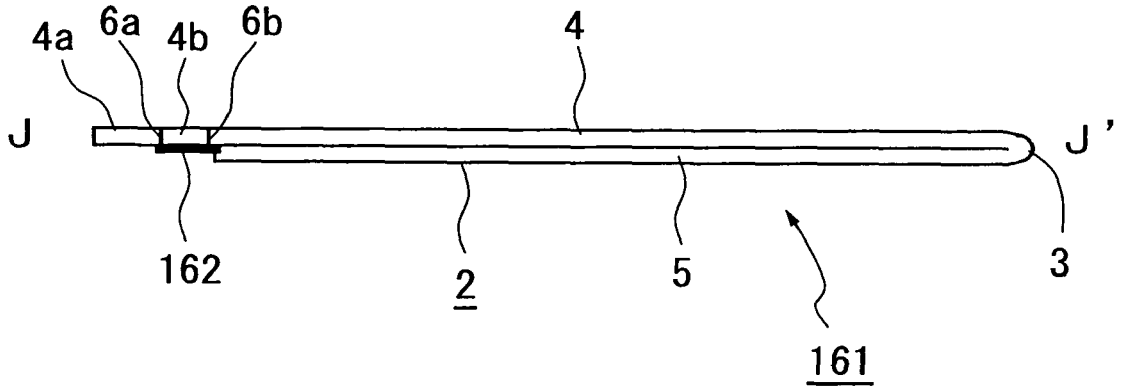
FIG. 45 is a schematic cross-sectional view taken along a line J-J' in FIG. 44.
Figure 46:
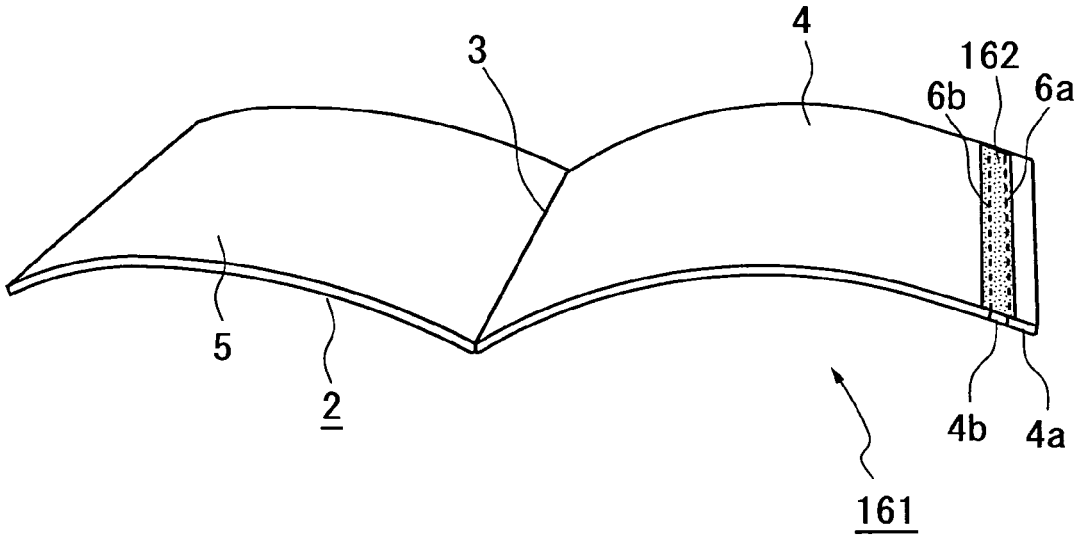
FIG. 46 is a schematic expansion view prior to folding, showing the folded label shown in FIG. 44.

FIG. 44 is a schematic perspective view of a folded label 161 according to a sixteenth embodiment of the present invention. FIG. 44 corresponds to FIG. 8. FIG. 45 is a schematic cross-sectional view taken along a line J-J' in FIG. 44. FIG. 46 is a schematic expansion view prior to folding, showing the folded label 161 according to the present embodiment. In FIGS. 44 to 46, components identical or corresponding to those in FIG. 8 are designated by the same reference numerals, and repetitive description thereon is omitted.

The folded label 161 according to the present embodiment differs from the folded label 31 shown in FIG. 8 only in the following two points. First, perforated lines 6*a* and 6*b* for separating a first sheep section 4 into parts on a side of a folding line 3 and a side opposite to the side are formed in a protruding portion 4*a* of the first sheet section 4 in the present embodiment. Thus, a zonal tear-off portion 4*b* partitioned by the perforated lines 6*a* and 6*b* contains only one part of the protruding portion 4*a*. Second, a release agent 162 is formed on a lower surface side of the tear-off portion 4*b* and around the tear-off portion 4*b* in the present embodiment. The release agent 162 is not formed in a region along an end portion (an opposite end portion to the folding line 3) of the protruding portion 4*a* of the first sheet section 4.

Figure 47:
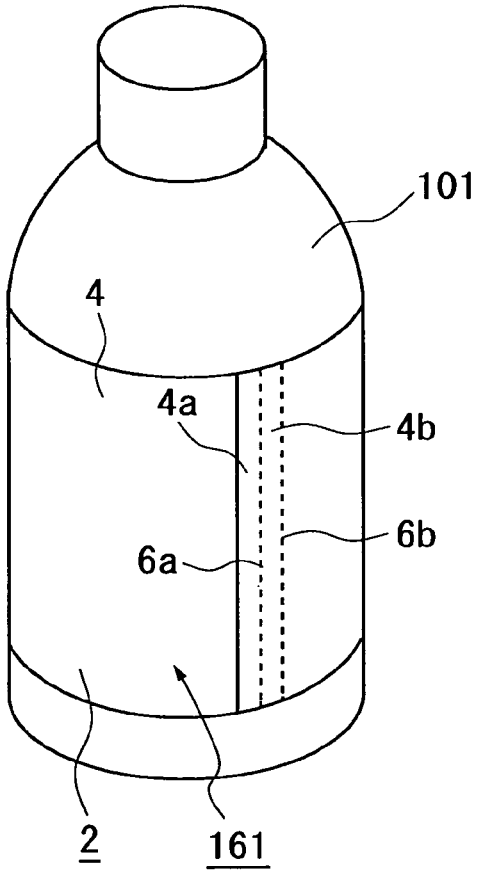
FIG. 47 is a schematic perspective view showing a state that the folded label shown in FIG. 44 is attached to a bottle.
Figure 48:
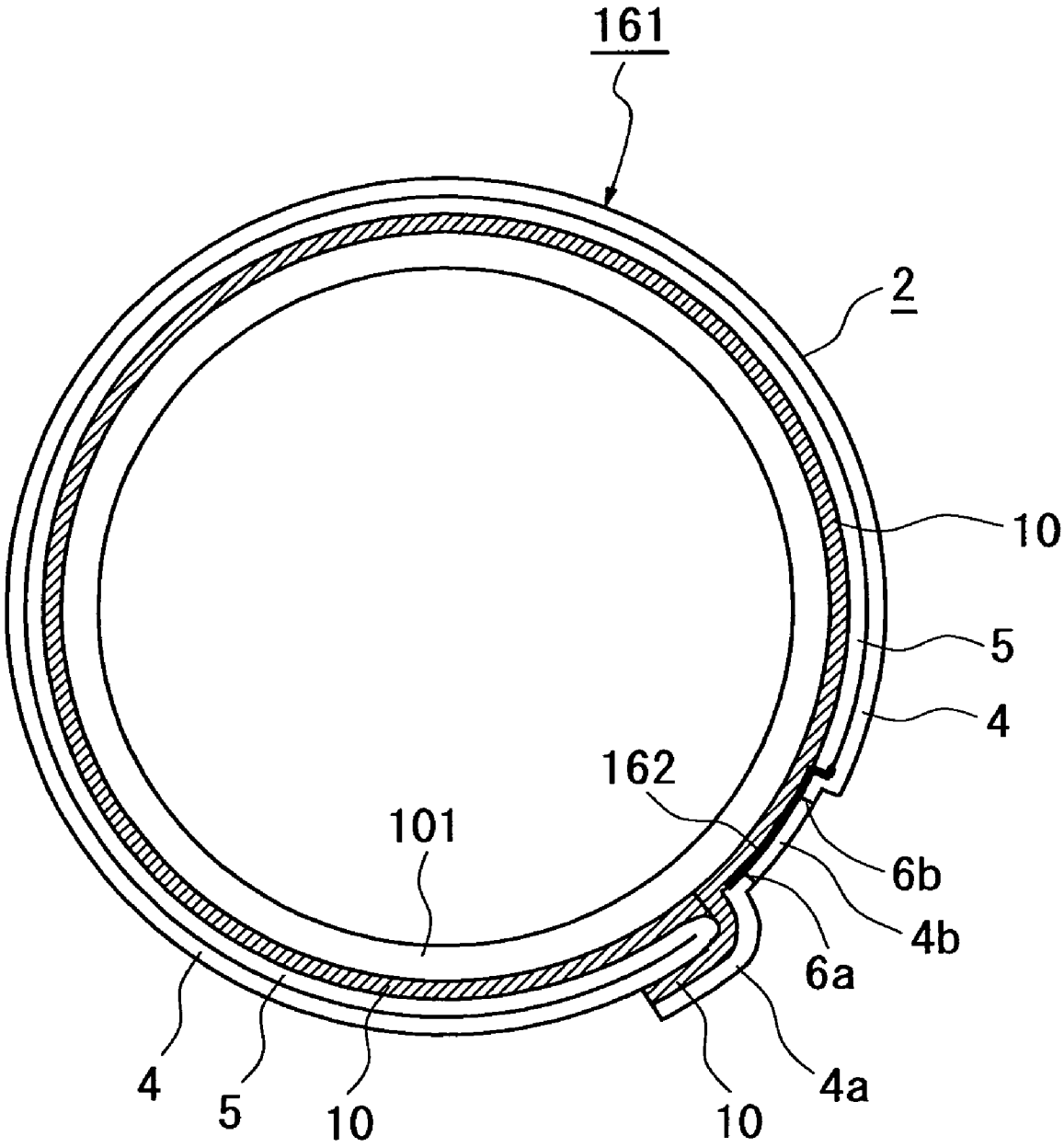
FIG. 48 is a schematic transverse cross-sectional view of the article with a folded label shown in FIG. 47.

FIG. 47 is a schematic perspective view showing a state that the folded label 161 according to the present embodiment is attached to a bottle 101. FIG. 48 is a schematic transverse cross-sectional view of the article with a folded label shown in FIG. 47. As known from FIG. 48, a transverse length of the folded label 161 in FIG. 45 is set to be longer than one circumference of an outer circumferential surface of the bottle 101 in the present embodiment. In addition, the transverse length from the folding line 3 to the perforated line 6*a* in FIG. 45 is set to be almost equal to one circumference of the outer circumferential surface of the bottle 101.

In the present embodiment, the folded label 161 with the upper surface side facing outward in FIG. 45 and with the folding line 3 set as a winding initiation end portion is wound on the outer circumferential surface of a body portion of the bottle 101 so that the number of turns of the folded label 161 becomes more than one. An adhesive 10 is applied to the whole of a lower surface side of the folded label 161 in FIG. 45 and the whole of the lower surface side of the folded label 161 in FIG. 45 is adhered to opposite portions respectively.

The labeling machine shown in FIG. 6 can be fundamentally used for adhering the folded label 161 to the bottle 101 as in the present embodiment. However, the conveyer 26 can be changed properly in accordance with the bottle 101.

In the present embodiment, the respective sheet sections 4 and 5 are kept in a folded state by the adhesive 10 as shown in FIGS. 47 and 48. When a consumer or the like wants to watch the whole display contents of the folded label 161, the consumer or the like can unfold the folded label 161 easily by tearing off the tear-off portion 4*b* along the perforated lines 6*a* and 6*b*. Since the release agent 162 is formed on the lower surface of the tear-off portion 4*b*, the tear-off portion 4*b* is adhered to the bottle 101 by the adhesive 10 through the release agent 162. Accordingly, the tear-off portion 4*b* can be released comparatively easily so that the tear-off portion 4*b* can be torn off.

As described above, the folded label 161 according to the present embodiment uses only one sheet 2 and is formed by folding the sheet 2. However, none of portions of the sheet 2 adhered to each other. Accordingly, the production process becomes simple and cost can be reduced because it is not necessary to use a production apparatus which can perform application of an adhesive. In addition, the excess part of the folded label 161 over one circumference is adhered to the first circumference of the folded label 161 by the adhesive 10 in the present embodiment. Accordingly, even if the diameter of the outer circumference of the bottle 101 is small, there is no possibility that the respective sheet sections will be floating before the adhesive 10 is dried and hardened.

Figure 49:
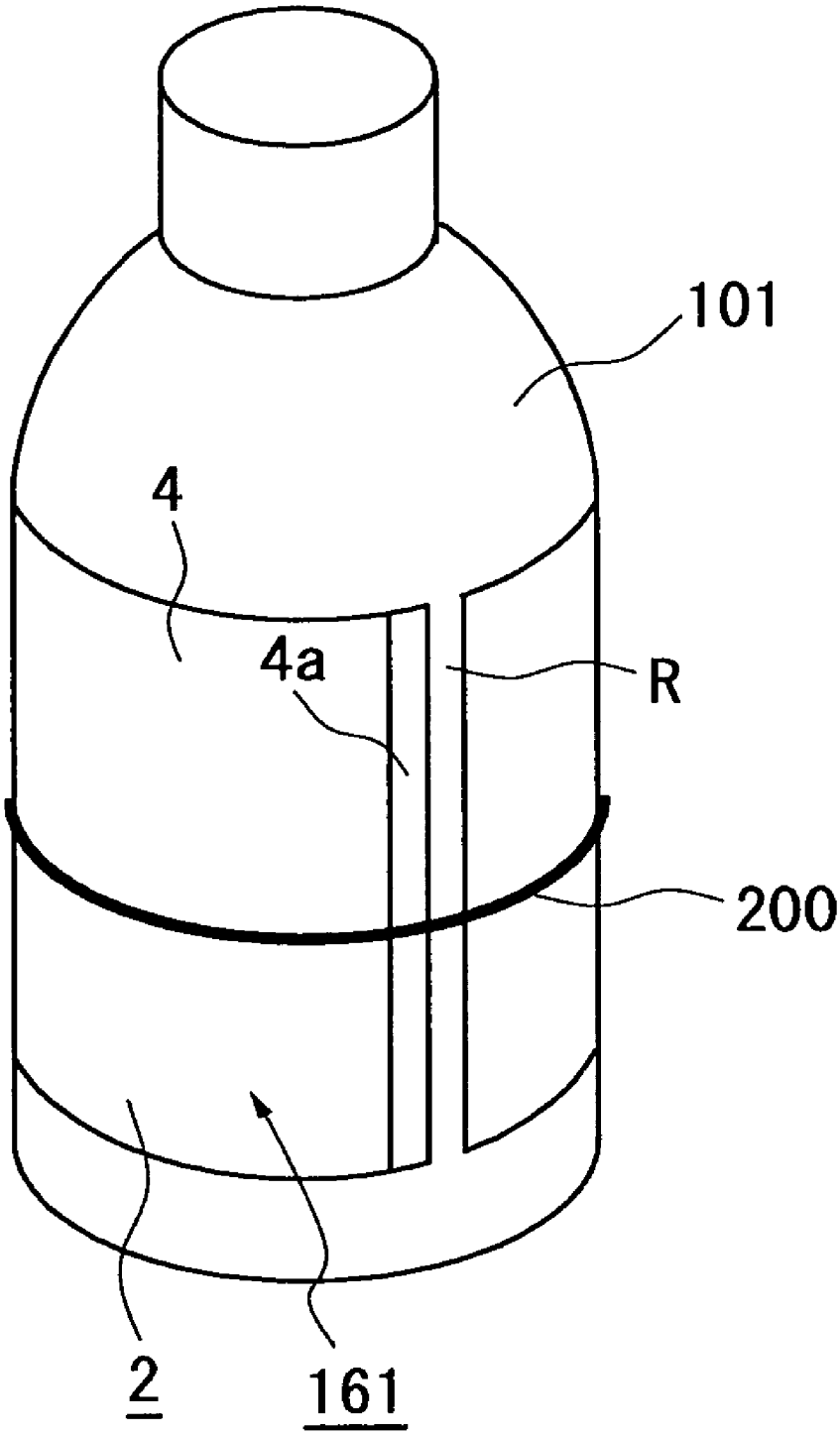
FIG. 49 is a schematic perspective view showing a predetermined state of the article with a folded label shown in FIG. 47.

After a consumer or the like tears off the tear-off portion 4*b*, unfolds the folded label 161 and watches the display contents, for example, the consumer or the like winds the folded label 161 on the bottle 101 and holds this state with a rubber band etc. 200, as shown in FIG. 49. After the zonal tear-off portion 4*b* has been torn off on this occasion, the bottle 101 in a region R where the tear-off portion 4*b* was attached is exposed to the outside. Accordingly, if the bottle 101 is transparent or translucent, it is very convenient that the residual amount of the bottle contents can be checked easily.

It is not always necessary to wind the folded label 161 according to the present embodiment on an article such as the bottle 101 so that the number of turns of the folded label 161 becomes more than one. For example, the adhesive 10 may be applied to the whole of the lower surface side of the folded label 161 in FIG. 45 in order to stick the folded label 161 on a bag 100 such as a rectangular-bottomed bag, in a manner similar to the case of FIG. 9. The point can also apply to respective embodiments which will be described later.

Seventeenth Embodiment

Figure 50:
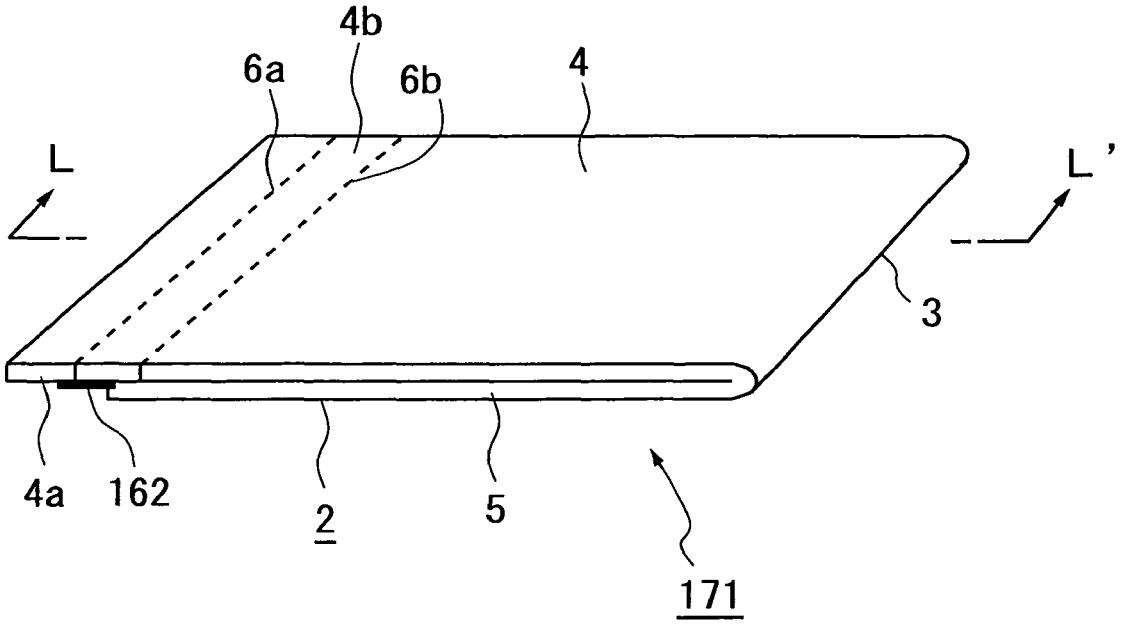
FIG. 50 is a schematic perspective view showing a folded label according to a seventeenth embodiment of the present invention.
Figure 51:
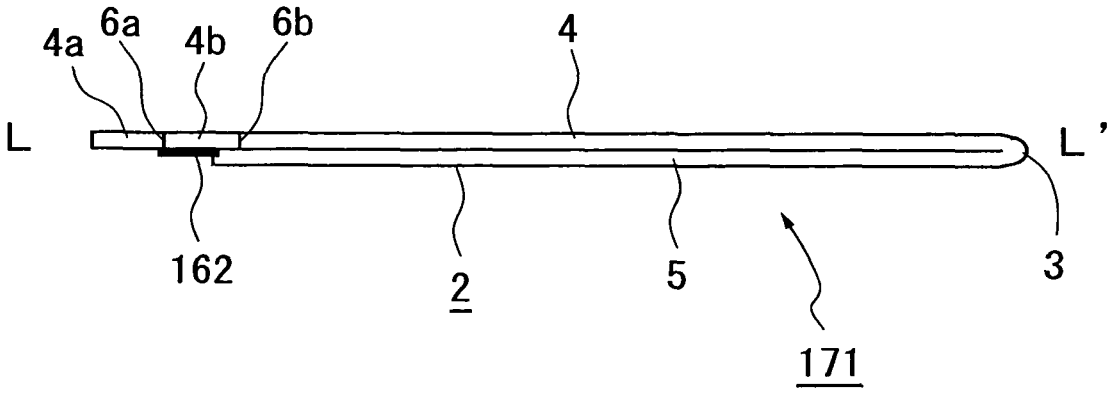
FIG. 51 is a schematic cross-sectional view taken along a line L-L' in FIG. 50.

FIG. 50 is a schematic perspective view of a folded label 171 according to a seventeenth embodiment of the present invention. FIG. 50 corresponds to FIG. 44. FIG. 51 is a schematic cross-sectional view taken along a line L-L' in FIG. 50. In FIGS. 50 and 51, components identical or corresponding to those in FIGS. 44 and 46 are designated by the same reference numerals, and repetitive description thereon is omitted.

The folded label 171 according to the present embodiment differs from the folded label 161 according to the sixteenth embodiment only in that a perforated line 6*b* is formed in a position to overlap a sheet section 5 and a zonal tear-off portion 4*b* contains not only one part of a protruding portion 4*a* but also another part than the protruding portion 4*a* in a sheet section 4.

The present embodiment also provides similar advantages to those of the sixteenth embodiment.

Eighteenth Embodiment

Figure 52:
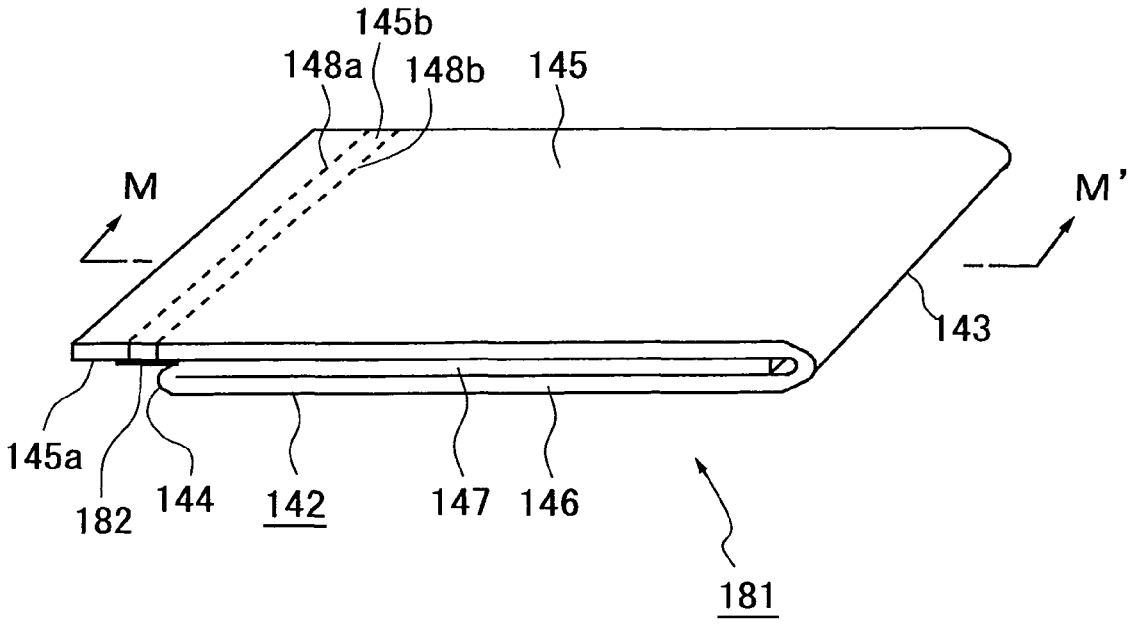
FIG. 52 is a schematic perspective view showing a folded label according to an eighteenth embodiment of the present invention.
Figure 53:
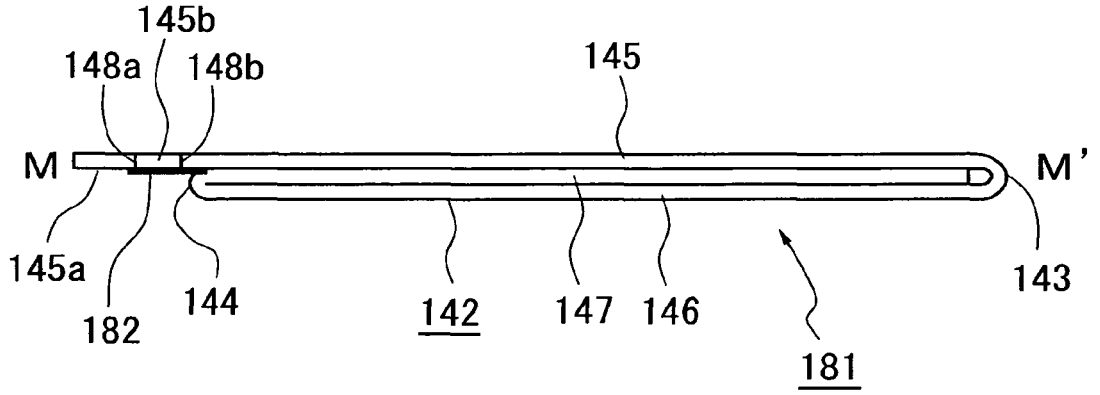
FIG. 53 is a schematic cross-sectional view taken along a line M-M' in FIG. 52.
Figure 54:
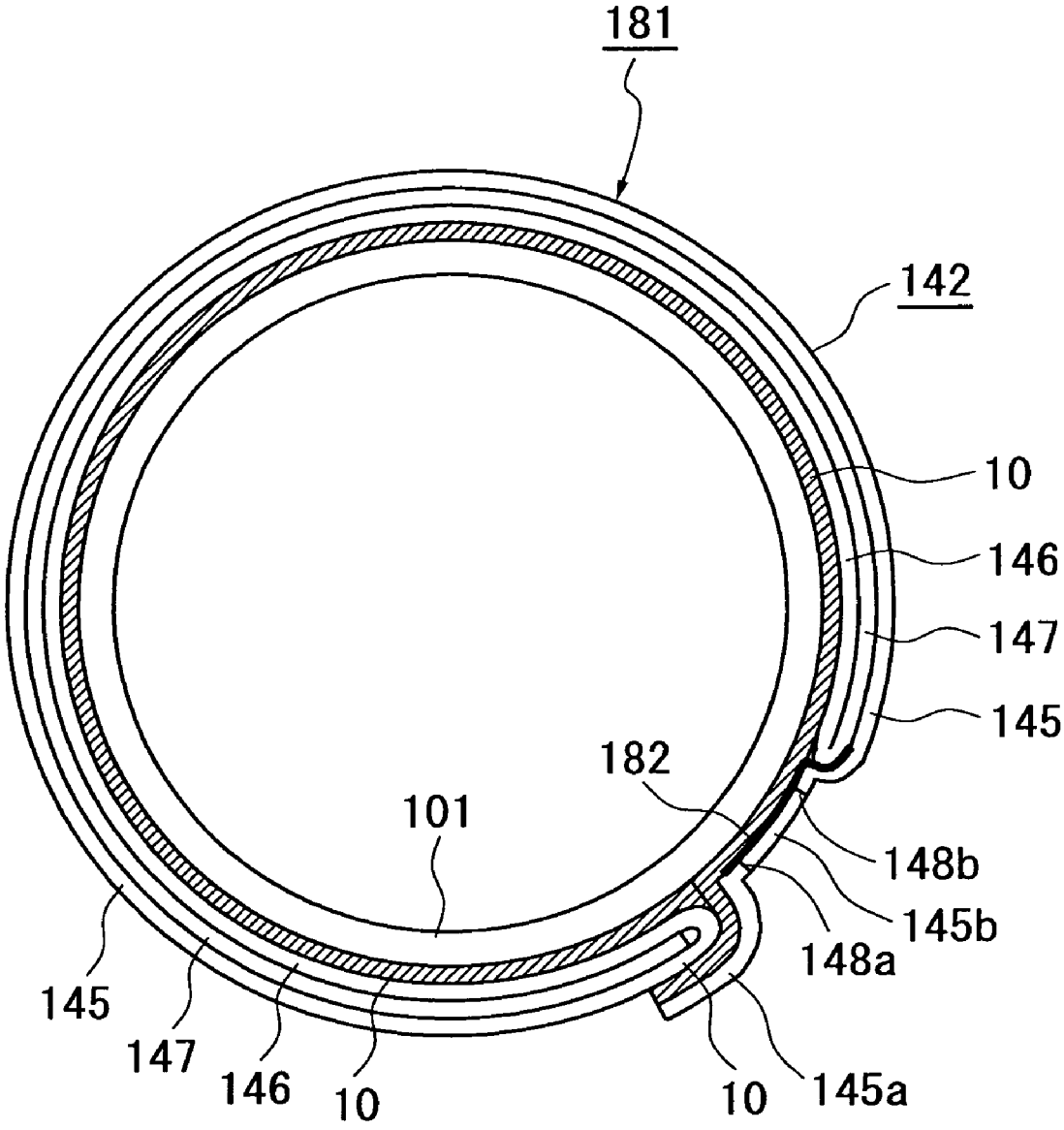
FIG. 54 is a schematic transverse cross-sectional view showing a bottle to which the folded label shown in FIG. 52 is attached.

FIG. 52 is a schematic perspective view of a folded label 181 according to an eighteenth embodiment of the present invention. FIG. 52 corresponds to FIG. 33. FIG. 53 is a schematic cross-sectional view taken along a line M-M' in FIG. 52. FIG. 54 is a schematic transverse cross-sectional view showing a bottle 101 to which the folded label 181 according to the present embodiment is attached. FIG. 54 corresponds to FIG. 48. In FIGS. 52 and 53, components identical or corresponding to those in FIGS. 33 and 34 are designated by the same reference numerals, and repetitive description thereon is omitted.

The folded label 181 according to the present embodiment differs from the folded label 141 shown in FIGS. 33 and 34 only in the following two points. First, perforated lines 148*a* and 148*b* for separating a first sheep section 145 into parts on a side of a first folding line 143 and a side opposite to the side are formed in a protruding portion 145*a* of the first sheet section 145 in the present embodiment. Thus, a zonal tear-off portion 145*b* partitioned by the perforated lines 148*a* and 148*b* contains only one part of the protruding portion 145*a*. Second, a release agent 182 is formed on a lower surface side of the tear-off portion 145*b* and around the tear-off portion 145*b* in the present embodiment. The release agent 182 is not formed in a region along an end portion (an opposite end portion to the folding line 3) of the protruding portion 145*a* of the first sheet section 145.

As known from FIG. 54, a transverse length of the folded label 181 in FIG. 53 is set to be longer than one circumference of an outer circumferential surface of the bottle 101 in the present embodiment. In addition, the transverse length from the folding line 143 to the perforated line 148*a* in FIG. 53 is set to be almost equal to one circumference of the outer circumferential surface side of the bottle 101.

In the present embodiment, the folded label 181 with the upper surface side facing outward in FIG. 53 and with the folding line 143 set as a winding initiation end portion is wound on the outer circumferential surface of a body portion of the bottle 101 so that the number of turns of the folded label 181 becomes more than one. An adhesive 10 is applied onto the whole of a lower surface side of the folded label 181 in FIG. 53 and the whole of the lower surface side of the folded label 181 in FIG. 53 is adhered to opposite portions respectively.

The labeling machine shown in FIG. 6 can be fundamentally used for adhering the folded label 181 to the bottle 101 as in the present embodiment. However, the conveyer 26 can be changed properly in accordance with the bottle 101.

The present embodiment also provides similar advantages to those of the sixteenth embodiment.

Figure 55:
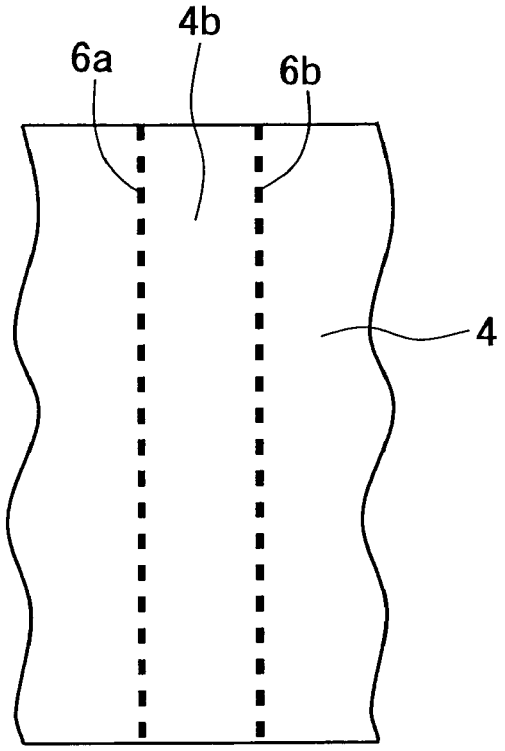
FIG. 55 are schematic plan views showing respective pattern examples of perforated lines.
Figure 55:
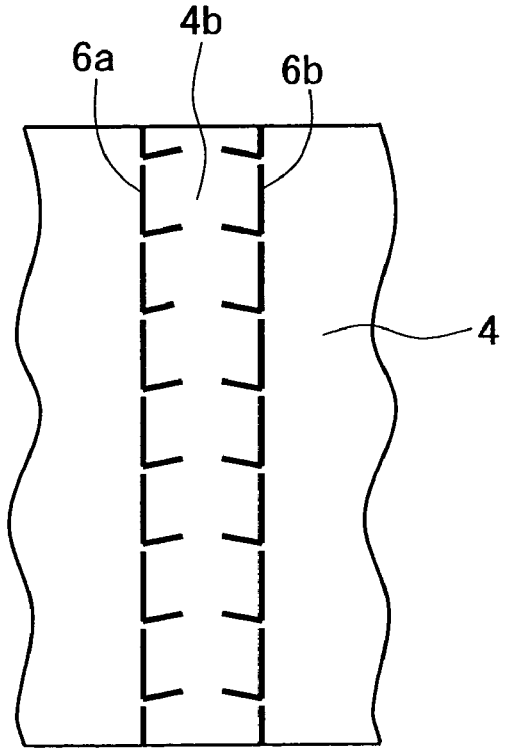

Pattern examples of the perforated lines which can be used in the present invention will be described with reference to FIG. 55. FIG. 55(*a*) is a partially enlarged plan view showing a pattern example of the perforated lines 6*a* and 6*b* used in FIG. 1. FIG. 55(*b*) is a partially enlarged plan view showing another pattern example of the perforated lines 6*a* and 6*b*. Each perforated line means a pattern of perforations provided intermittently so that cutting can be made along the perforations. The perforated line is not limited to a simple dotted line pattern shown in FIG. 55(*a*). For example, the pattern shown in FIG. 55(*b*) may be used.

Although the respective embodiments of the present invention have been described above, the present invention is not limited to these embodiments. For example, the number of sheet sections may be 5 or more.

The invention claimed is:

1. A method for manufacturing an article with a folded label which uses only one sheet having display contents described on predetermined portions on both surface sides of the sheet and which is formed by folding the sheet without any portions of the sheet adhered to each other, the folded label comprising: (i) among a plurality of sheet sections superposed over each other each into which the sheet is partitioned by one or more folding lines, first and second sheet sections adjacent and continuous to each other through a first folding line of the one or more folding lines appear on one surface side and the other surface side of the folded label, respectively, when the folded label is folded; (ii) only the first sheet section appears on the one surface side of the folded label; (iii) the second sheet section and only one part of the first sheet section constituting a protruding portion protruding from the second sheet section on a side opposite to a side of the first folding line appear on the other surface side of the folded label; and (iv) one or a plurality of perforated lines for separating the first sheet section into parts on sides of the protruding portion and the first folding line are formed on the first sheet section, wherein the protruding portion and the second sheet section of the folded label on the other surface side of the folded label are adhered to the article by an adhesive, the method comprising the steps of:

preparing the folded label and the article to which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

2. An article with a folded label which uses only one sheet having display contents described on predetermined portions on both surface sides of the sheet and which is formed by folding the sheet without any portions of the sheet adhered to each other, comprising:

among a plurality of sheet sections superposed over each other each into which the sheet is partitioned by one or more folding lines, first and second sheet sections adjacent and continuous to each other through a first folding line of the one or more folding lines appear on one surface side and the other surface side of the folded label, respectively, when the folded label is folded;

only the first sheet section appears on the one surface side of the folded label;

the second sheet section and only one part of the first sheet section constituting a protruding portion protruding from the second sheet section on a side opposite to a side of the first folding line appear on the other surface side of the folded label; and one or a plurality of perforated lines for separating the first sheet section into parts on sides of the protruding portion and the first folding line are formed on the first sheet section wherein the folded label with the one surface side facing outward and with the first folding line set as a winding initiation end portion is wound on an outer circumferential surface of the article so that the number of turns of the folded label becomes more than one, at least one part of the second sheet section of the folded label on the other surface side of the folded label is adhered to the article by an adhesive, and at least one part of the protruding portion of the folded label on the other surface side of the folded label is adhered to one part of the first sheet section located on the one surface side of the folded label and facing the part of the protruding portion by the adhesive.

3. A method for manufacturing the article according to claim 2 with the folded label, comprising the steps of:

preparing the folded label and the article to which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

4. A method for manufacturing an article with a folded label which uses only one sheet having display contents described on predetermined portions on both surface sides of the sheet and which is formed by folding the sheet without any portions of the sheet adhered to each other, the folded label comprising: (i) among three or more sheet sections superposed over each other each into which the sheet is partitioned by two or more folding lines, first and second sheet sections adjacent and continuous to each other through a first folding line of the two or more folding lines appear on one surface side and the other surface side of the folded label, respectively, when the folded label is folded; (ii) a third sheet section of the three or more sheet sections is adjacent and continuous to the first sheet section through a second folding line of the two or more folding lines; (iii) the first and second folding lines are located on opposite sides of the first sheet section; (iv) only the first sheet section appears on the one surface side of the folded label; (v) the second sheet section and only one part of the third sheet section constituting a protruding portion protruding from the second sheet section on a side opposite to the side of the first folding line appear on the other surface side of the folded label; and (vi) one or a plurality of perforated lines for separating the first sheet section into parts on sides of the first folding line and the second folding line are formed on the first sheet section, wherein the protruding portion and the second sheet section of the folded label on the other surface side of the folded label are adhered to the article by an adhesive, the method comprising the steps of:

preparing the folded label and the article on which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

5. An article with a folded label which uses only one sheet having display contents described on predetermined portions on both surface sides of the sheet and which is formed by folding the sheet without any portions of the sheet adhered to each other, comprising:

among three or more sheet sections superposed over each other each into which the sheet is partitioned by two or more folding lines, first and second sheet sections adjacent and continuous to each other through a first folding line of the two or more folding lines appear on one surface side and the other surface side of the folded label, respectively, when the folded label is folded;

a third sheet section of the three or more sheet sections is adjacent and continuous to the first sheet section through a second folding line of the two or more folding lines;

the first and second folding lines are located on opposite sides of the first sheet section;

only the first sheet section appears on the one surface side of the folded label;

the second sheet section and only one part of the third sheet section constituting a protruding portion protruding from the second sheet section on a side opposite to the side of the first folding line appear on the other surface side of the folded label; and one or a plurality of perforated lines for separating the first sheet section into parts on sides of the first folding line and the second folding line are formed on the first sheet section, wherein the folded label with the one surface side facing outward and with the first folding line set as a winding initiation end portion is wound on an outer circumferential surface of the article so that the number of turns of the folded label becomes more than one, at least one part of the second sheet section of the folded label on the other surface side of the folded label is adhered to the article by an adhesive, and at least one part of the protruding portion of the folded label on the other surface side of the folded label is adhered to one part of the first sheet section located on the one surface side of the folded label and facing the part of the protruding portion by the adhesive.

6. A method for manufacturing the article according to claim 5 with the folded label, comprising the steps of:

preparing the folded label and the article to which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

7. A method for manufacturing a folded label which uses only one sheet having display contents described on predetermined portions on opposite surface sides of the sheet and which is formed by folding the sheet without any portions of the sheet adhered to each other, the folded label comprising: (i) among a plurality of sheet sections superposed over each over each into which the sheet is partitioned by one or more folding lines, first and second sheet sections adjacent and continuous to each other through a first folding line of the one or more folding lines appear on one surface side and the other surface side of the folded label, respectively, when the folded label is folded; (ii) only the first sheet section appears on the one surface side of the folded label; (iii) the second sheet section and only one part of the first sheet section constituting a protruding portion protruding from the second sheet section on a side opposite to the side of the first folding line appear on the other surface side of the folded label; and (iv) a release agent is formed on the protruding portion on the other surface side of the folded label, wherein the protruding portion and the second sheet section of the folded label on the other surface side of the folded label are adhered to the article by an adhesive, the method comprising the steps of:

preparing the folded label and the article on which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

8. An article with a folded label which uses only one sheet having display contents described on predetermined portions on opposite surface sides of the sheet and which is formed by folding the sheet without any portions of the sheet adhered to each other, comprising:

among a plurality of sheet sections superposed over each over each into which the sheet is partitioned by one or more folding lines, first and second sheet sections adjacent and continuous to each other through a first folding line of the one or more folding lines appear on one surface side and the other surface side of the folded label, respectively, when the folded label is folded;

only the first sheet section appears on the one surface side of the folded label;

the second sheet section and only one part of the first sheet section constituting a protruding portion protruding from the second sheet section on a side opposite to the side of the first folding line appear on the other surface side of the folded label; and a release agent is formed on the protruding portion on the other surface side of the folded label, wherein the folded label with the one surface side facing outward and with the first folding line set as a winding initiation end portion is wound on an outer circumferential surface of the article so that the number of turns of the folded label becomes more than one, at least one part of the second sheet section of the folded label on the other surface side of the folded label is adhered to the article by an adhesive, and at least one part of the protruding portion of the folded label on the other surface side of the folded label is adhered to one part of the first sheet section located on the one surface side of the folded label and facing the part of the protruding portion by the adhesive.

9. A method for manufacturing the article according to claim 8 with the folded label, comprising the steps of:

preparing the folded label and the article to which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

10. A method for manufacturing an article with a folded label which uses only one sheet having display contents described on predetermined portions on both surface sides of the sheet and which is formed by folding the sheet without any portions of the sheet adhered to each other, the folded label comprising: (i) among three or more sheet sections superposed over each other each into which the sheet is partitioned by two or more folding lines, first and second sheet sections adjacent and continuous to each other through a first folding line of the two or more folding lines appear on one surface side and the other surface side of the folded label, respectively, when the folded label is folded; (ii) a third sheet section of the three or more sheet sections is adjacent and continuous to the first sheet section through a second folding line of the two or more folding lines; (iii) the first and second folding lines are located on opposite sides of the first sheet section; (iv) only the first sheet section appears on the one surface side of the folded label; (v) the second sheet section and only one part of the third sheet section constituting a protruding portion protruding from the second sheet section on a side opposite to the side of the first folding line appear on the other surface side of the folded label; and (vi) a release agent is formed on the protruding portion on the other surface side of the folded label, wherein the protruding portion and the second sheet section of the folded label on the other surface side of the folded label are adhered to the article by an adhesive, the method comprising the steps of preparing the folded label and the article on which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

11. An article with a folded label which uses only one sheet having display contents described on predetermined portions on both surface sides of the sheet and which is formed by folding the sheet without any portions of the sheet adhered to each other, comprising:

among three or more sheet sections superposed over each other each into which the sheet is partitioned by two or more folding lines, first and second sheet sections adjacent and continuous to each other through a first folding line of the two or more folding lines appear on one surface side and the other surface side of the folded label, respectively, when the folded label is folded;

a third sheet section of the three or more sheet sections is adjacent and continuous to the first sheet section through a second folding line of the two or more folding lines;

the first and second folding lines are located on opposite sides of the first sheet section;

only the first sheet section appears on the one surface side of the folded label;

the second sheet section and only one part of the third sheet section constituting a protruding portion protruding from the second sheet section on a side opposite to the side of the first folding line appear on the other surface side of the folded label; and a release agent is formed on the protruding portion on the other surface side of the folded label, wherein the folded label with the one surface side facing outward and with the first folding line set as a winding initiation end portion is wound on an outer circumferential surface of the article so that the number of turns of the folded label becomes more than one, at least one part of the second sheet section of the folded label on the other surface side of the folded label is adhered to the article by an adhesive, and at least one part of the protruding portion of the folded label on the other surface side of the folded label is adhered to one part of the first sheet section located on the one surface side of the folded label and facing the part of the protruding portion by the adhesive.

12. A method for manufacturing the article according to claim 11 with the folded label, comprising the steps of:

preparing the folded label and the article to which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

13. An article with a folded label which uses only one sheet having display contents described on predetermined portions on both surface sides of the sheet and which is formed by folding the sheet without any portions of the sheet adhered to each other, comprising:

among a plurality of sheet sections superposed over each other each into which the sheet is partitioned by one or more folding lines, first and second sheet sections adjacent and continuous to each other through a first folding line of the one or more folding lines appear on one surface side and the other surface side of the folded label, respectively, when the folded label is folded;

only the first sheet section appears on the one surface side of the folded label;

the second sheet section and only one part of the first sheet section constituting a protruding portion protruding from the second sheet section on a side opposite to a side of the first folding line appear on the other surface side of the folded label;

a plurality of perforated lines for separating the first sheet section into parts on a side of the first folding line and a side opposite to the side are formed on the first sheet section:

the plurality of perforated lines form a zonal tear-off portion which can be torn off in the first sheet section;

the tear-off portion contains a part of the protruding portion; and a release agent is formed on the protruding portion on the other surface side of the folded label and around the tear-off portion, wherein the folded label with the one surface side facing outward and with the first folding line set as a winding initiation end portion is wound on an outer circumferential surface of the article so that the number of turns of the folded label becomes more than one, at least one part of the second sheet section of the folded label on the other surface side of the folded label is adhered to the article by an adhesive, one part of the protruding portion of the folded label on the other surface side of the folded label is adhered to one part of the first sheet section located on the one surface side of the folded label and facing the part of the protruding portion by the adhesive, the other part of the protruding portion of the folded label on the other surface side of the folded label is adhered to the article facing the other part of the protruding portion by the adhesive, and the article is a transparent or translucent container.

14. A method for manufacturing the article according to claim 13 with the folded label, comprising the steps of:

preparing the folded label and the article to which the folded label is to be attached;

applying an adhesive onto the protruding portion and the second sheet section of the folded label on the other surface side of the folded label by a coating roller while rotating an adsorption drum in a rotation direction in a state that the folded label with the other surface side facing outward is adsorbed by the adsorption drum while the folded label with the protruding portion side facing backward in the rotation direction of the adsorption drum and with the first folding line side facing forward in the rotation direction of the adsorption drum is adsorbed by the adsorption drum; and pressing the folded label coated with the adhesive against the article by the adsorption drum while rotating the adsorption drum in the rotation direction to thereby adhere the protruding portion and the second sheet section of the folded label on the other surface side of the folded label to the article by the adhesive.

* * * * *